US006286736B1

(12) United States Patent
Angus et al.

(10) Patent No.: US 6,286,736 B1
(45) **Date of Patent: *Sep. 11, 2001**

(54) CLIPABLE ARTICLE CONTAINER

(76) Inventors: June Angus; Keith Willows, both of 1823 12th Ave. West, Seattle, WA (US) 98119

( * ) Notice: Subject to any disclaimer, the term of this patent is extended or adjusted under 35 U.S.C. 154(b) by 0 days.

This patent is subject to a terminal disclaimer.

(21) Appl. No.: 09/481,899

(22) Filed: Jan. 12, 2000

Related U.S. Application Data

(63) Continuation of application No. 09/036,056, filed on Mar. 6, 1998, now Pat. No. 6,082,600.

(60) Provisional application No. 60/040,350, filed on Mar. 8, 1997.

(51) Int. Cl.[7] ..... A45F 5/00

(52) U.S. Cl. ..... 224/269; 224/666; 224/667; 224/668; 224/236; 224/237; 224/245; 24/3.7

(58) Field of Search ..... 224/194, 665, 224/670, 235, 236, 237, 242, 245, 269, 222; 24/458, 541, 3.11, 3.12, 3.7

(56) References Cited

U.S. PATENT DOCUMENTS

| | | | | |
|---|---|---|---|---|
| 733,765 | | 7/1903 | Stroh . | |
| 1,314,392 | | 8/1919 | Glamzo . | |
| 3,808,642 | | 5/1974 | Nation . | |
| 3,907,182 | | 9/1975 | Bryant . | |
| 3,982,675 | | 9/1976 | Claypool . | |
| 4,044,933 | * | 8/1977 | Artz | 224/666 |
| 4,060,876 | | 12/1977 | De Soto . | |
| 4,201,259 | | 5/1980 | Alsdorf . | |
| 4,226,006 | | 10/1980 | Toyama . | |
| 4,237,583 | | 12/1980 | Sullivan . | |
| 4,416,315 | | 11/1983 | Foley . | |
| 4,444,342 | | 4/1984 | Powell . | |
| 4,463,482 | | 8/1984 | Hawie . | |
| 4,580,347 | | 4/1986 | McKnight . | |
| 4,626,457 | | 12/1986 | Willie . | |
| 4,705,086 | | 11/1987 | O'Neill . | |
| 4,728,037 | | 3/1988 | Mainhardt . | |
| 4,903,745 | | 2/1990 | Roman . | |
| 4,915,215 | | 4/1990 | Brekke . | |
| 5,103,884 | | 4/1992 | Roman . | |
| 5,114,061 | | 5/1992 | Brady . | |
| 5,244,023 | | 9/1993 | Spies . | |
| 5,312,029 | | 5/1994 | Tuber . | |
| 5,452,497 | | 9/1995 | Peng . | |
| 5,460,346 | | 10/1995 | Hirsch . | |
| 5,524,802 | | 6/1996 | Benson et al. . | |
| 5,533,656 | | 7/1996 | Bonaldi . | |
| 5,588,571 | | 12/1996 | Mazzo . | |
| 6,082,600 | * | 7/2000 | Angus et al. | 224/269 |

* cited by examiner

*Primary Examiner*—Gregory M. Vidovich
(74) *Attorney, Agent, or Firm*—Christensen O'Connor Johnson Kindness PLLC

(57) ABSTRACT

A container detachably securable to an article of clothing or other item. The container includes a first panel and a second panel. The first and second panels are attached at their peripheral edges to form a pouch with an opening thereto. The pouch defines exterior and interior surfaces. The container further includes a clamp secured to the pouch for detachably securing the container to an article of clothing or other item. The container still further includes a flap extending from the second panel adjacent the opening to the pouch. The flap folds over the exterior surface of the first panel and the clamp secured thereto, is fastenable to the clamp, and is liftable to open the pouch while the clamp remains secured to the exterior surface of the first panel.

33 Claims, 18 Drawing Sheets

CLIPABLE ARTICLE CONTAINER

CROSS REFERENCE TO PROVISIONAL PATENT APPLICATION

The present application is a continuation of U.S. patent application Ser. No. 09/036,056, filed Mar. 6, 1998 now U.S. Pat. No. 6,082,600 and which claims the benefit under 35 U.S.C. § 119(e) of U.S. provisional application Ser. No. 60/040,350, filed Mar. 8, 1997.

FIELD OF THE INVENTION

The present invention relates to a secure device for carrying personal items and valuables, and more particularly, to such a device that can be removably secured to a person's clothing or the like.

BACKGROUND OF THE INVENTION

Concern for the prevention of theft, accidental loss, or general secure containment of personal articles detachably carried on one's person, for travel sports and fitness, or general daily use, has resulted in numerous inventions intended to address this problem. Many of these inventions include conventional fanny packs, money belts, wrist and shoe attaching pockets, belt-supported receptacles, wallets with clip assemblies attachable to a belt and pouches with purported locking clips for securely locking the same to articles of clothing. While the prior art devices referred to provide a limited degree of protection for carrying valuables, they posses certain drawbacks that render them not entirely satisfactory.

Security receptacles that utilize a waist strap, such as with money belts and fanny packs, decrease comfort and restrict movement. When a money belt is worn under apparel, the user must inconveniently retreat to a private area to retrieve articles. Smaller solutions such as wrist, ankle, and shoe pockets all attach to an appendage causing a risk of loss to articles contained due to recurrent movement of the appendage. Additionally, during use of these devices in physical activity, performance and comfort are hindered by the attachment of such a device to an appendage on one side of the body. In addition to advertising valuables, these are subject to limited versatility due to factors relating to their bodily attachment location and means. Security pockets or receptacles incorporated into the construction of garments tend to reduce the aesthetic appeal of such garments and limit containment use to the garment in which the receptacle is incorporated. Wallets and pouches that utilize a neck strap are less accessible if worn under clothing, not concealed if worn outside of clothing, movement constricting, uncomfortable and neck straps may be easily cut allowing the article container to be removed, knowingly or unknowingly, from the wearer. Wallets with secure belt loop attachments are limited in that the user must either remove his or her belt in order to position or remove the receptacle. Also, the user is limited to use of the receptacle when wearing a belt or items with a waist strap. Additionally, the receptacle may slide off, when the user undoes their belt to undress or uses the restroom, jeopardizing security of items contained.

Several other inventions have attempted to overcome some of the disadvantages of the previously mentioned disclosures for carrying valuables. A variety of wallets and pouches with removable or permanent clip assemblies attempt to allow the user to removably retain a wallet or receptacle, for carrying items, onto the wearer's clothing. Although these attempt to address some of the previously mentioned disadvantages, are generally closer in category to the current invention, all the receptacles of this nature heretofore known suffer from a variety of disadvantages.

First, the clip mechanism or clipping device utilized is primary in determining how secure the receptacle, and its contents, will ultimately be against inadvertent loss or theft of the receptacle. In previous inventions clipping mechanisms disclosed generally, among other issues, suffer from drawbacks in one or more of the following key areas: gripping effectiveness and security, ease of use, and manufacturability. Generally as with the case with "U" or hairpin-style slide-on clips such as in U.S. Pat. Nos. 4,416,315 to Foley (1983) and 4,903,745 to Roman (1990) and with spring clips, the gripping friction and the ease of use are conversely proportionate, limiting the ability of these clips, and thus, devices to provide both ease of use and secure gripping means concurrently. For example, if the clipping mechanism is easy to clip onto the items to which it is intended to grip, such as the types suggested above, then it is likely not to deliver a high level of frictional engagement for securely holding the receptacle to the user. Conversely, because it may be designed such that it improves gripping effectiveness, as with a tight spring clip or a barbed "U" clip, it generally falls short on ease of use. Thus, the harder it clamps, the more force it takes to pinch or actuate the clip for use and removal Other inventions have attempted to provide better clipping effectiveness with alternative clip designs. These suffer from, among other things, drawbacks in the areas of complexity of use and manufacturing inefficiency, and may cause damage to the articles they are intended to clip to. Clips such as those proposed in U.S. Pat. Nos. 4,237,583 to Sullivan (1980), and 5,114,061 to Brady (1992) are examples of clips that are subject to one or more of these disadvantages.

In addition to the above, inventions heretofore known suffer from drawbacks and disadvantages combinations of the following areas:

Threatened security of receptacle or articles contained
May damage garment or fabric when in use
Causes user discomfort
Poorly integrated features
Limited accessibility
Lacks versatility for range of use
Inconvenient and difficult to use
Inefficient or prohibitive to manufacture
Unreliable in operation and subject to failure
Incorporates odd or complex mechanisms A need has arisen, therefore, for a comfortable, attractive, convenient, simple, reliable and cost-effective device for carrying valuables for use in a wide variety of situations and actives. The article-carrying device of the present invention meets this need and overcomes the aforementioned disadvantages.

There has now been developed, and disclosed herein a new and novel device that has a number of advantages not possessed by the products of this type known heretofore to be available. A clipable article container embodying the principles of the invention has a container or pocket portion for containing personal articles; a clip or clamping mechanism or portion, enabling the container portion to be releasably attached to an article of clothing or other item; and means of attaching the clip or clamping portion to the container portion. Accordingly, several objects and advantages of the present invention are:

A) To provide a clipable article container that overcomes the above and other shortcomings of known attachable, article receptacles, pouches, or wallets.

B) To provide a clipable article container whose clamp allows it to be more securely lockclamped to a user or other articles.

C) To provide a clipable article container whose article containing cavities can more securely retain articles.

D) To provide a clipable article container whose clamp and related parts allow it to be clamped to and removed from the user more quickly, simply and easily.

E) To provide a clipable article container that provides superior accessibility to contents of the container while clamped on or not.

F) To provide a clipable article container that can be used more comfortably.

G) To provide a clipable article container that offers versatility in the ways it can be positioned on the user or other items.

H) To provide a clipable article container that can be effectively used for a wider range of activities, from everyday use to travel and sports.

I) To provide a clipable article container whose production allows for flexible and cost-efficient manufacturing and assembly.

J) To provide a clipable article container whose features are well and efficiently integrated for maximum convenience and functionality.

Still further objects and advantages will become apparent from consideration of the ensuing description and drawings.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

REFERENCE NUMERALS IN DRAWING FIGURES

Figure 1:
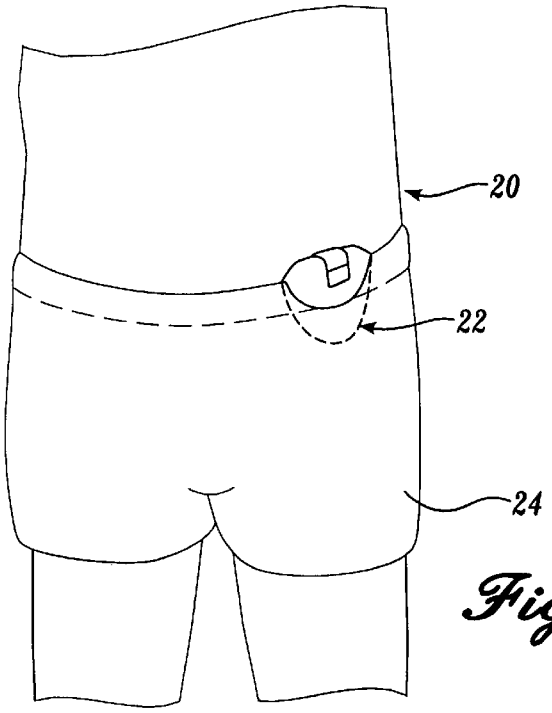
FIG. 1 is a front view of the present invention, attached in one typical position onto a waistband.

20. User 20
22. Clipable article container 22
22*a*. container or pouch portion 22*a*.
22*b*. holding clamp portion 22*b*
24. garment 24

26. pocket closure extension 26
28. container clamp interface flap 28
28*a*. container clamp interface dart 28*a*
30. container front panel 30
34. holding clamp closing member 34
34*a*. holding clamp closing member hips 34*a*
34*b*. holding clamp closing member short leg 34*b*
34*c*. closing member short leg projections 34*c*
36 upper clamp 36
36*a*. upper clamp teeth 36*a*
36*b*. upper clamp wings 36*b*
36*c*. upper clamp retainment tongue 36*c*
38. lower clamp 38
38*a*. lower clamp teeth 38*a*
38*b*. lower clamp retaitnent bend 38*b*
38*c*. lower clamp tongue retainment slot 38*c*
38*d*. lower clamp projection rests 38*d*
40. upstanding flanges 40
42. upstanding flange openings 42
44. holding clamp retention plate 44
44*a*. retention plate "U" cut 44*a*
44*b*. retention plate "U" cut projections 44*b*
44*c*. retention plate cut 44*c*
44*d*. retention plate cut 44*d*
44*e*. retention plate cut indents 44*e*
44*f*. plate thumb gripper 44*f*
44*g*. retention plate feed-in ramp 44*g*
45. plate texture 45
46. holding clamp closing member retainer 46
48. container rear panel 48
52. inside front panel pull-apart fastening means 52
54. inside rear panel pull-apart fastening means & flap 54
56. pocket extension pull-apart fastening means 56
58. clamp flap pull-apart fastening means 58
60. credit card 60
62. key 62
64. key (item) retention means 64
70. second embodiment of present invention 70
71. locking pivot of second embodiment 71
71*a*. locking pivot holes 71*a*
71*b*. locking pivot ring 71*b*
71*c*. locking pivot projections 71*c*
72. latch handle 72
72*a*. latch curve 72*a*
72*b*. latch projections 72*b*
72*c*. latch washer 72*c*
73. flap hole 73
74. closing member hole 74
75. upper clamp opening 75
75*a*. upper clamp opening indents 75*a*
75*b*. upper clamp opening voids 75*b*

SUMMARY OF THE INVENTION

In accordance with the present invention a container, detachably securable to an article of clothing or other item and for the receipt of articles, comprises a container or pocket portion, a clip or clamp portion secured to the container, and an optional retaining plate for joining the clip portion to the container portion.

DETAILED DESCRIPTION OF THE PREFERRED EMBODIMENT

Figure 4:
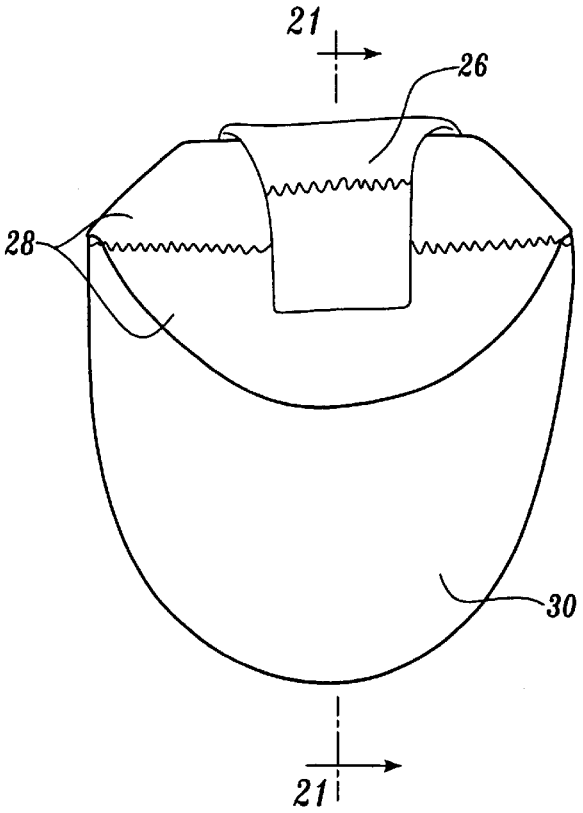
FIG. 4 is a front view showing the main front components of the container portion.
Figure 5:
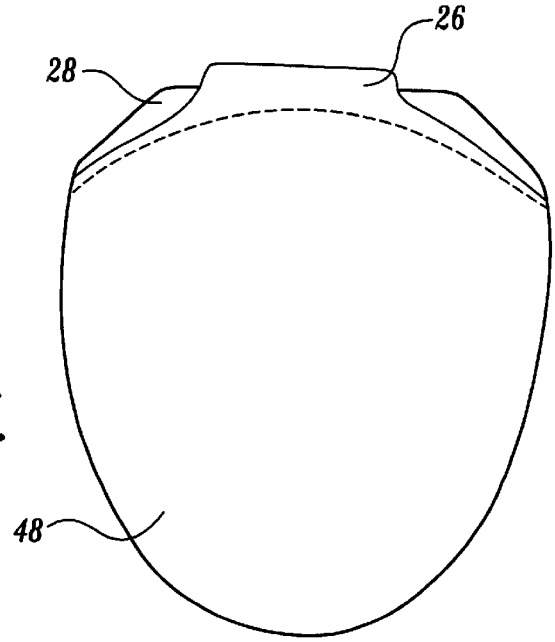
FIG. 5 is a rear view showing the main rear components of the container portion.

FIG. 1 of the preferred embodiment of the present invention shows a clipable article container 22 as worn inside the waistband of a garment 24, of user 20 in a front position. Clipable article container 22 consists of three main components—a receptacle, pocket, pouch, or container portion 22*a* shown from front and rear views in FIGS. 4 and 5, a holding clamp portion 22*b* shown from a perspective view in FIG. 7, and a holding clamp retention plate 44 first visible in FIG. 10. Container portion 22*a* is capable of receiving and retaining various items such as keys, money, food, electronics, and the like. Clamp portion 22*b* allows container portion 22*a* to be removably secured to clothing or other items. Retention plate 44 allows clamp portion 22*b* to be permanently or semipermanently attached to the container portion.

Container Portion Description—Preferred Embodiment

Figure 2:
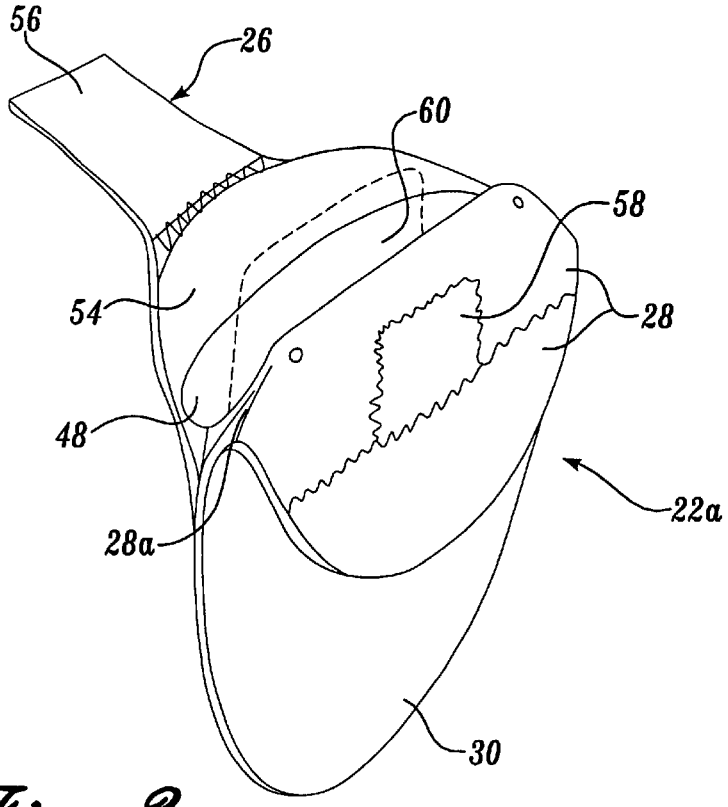
FIG. 2 is a front perspective view showing the container article cavity in an open position.
Figure 13A:
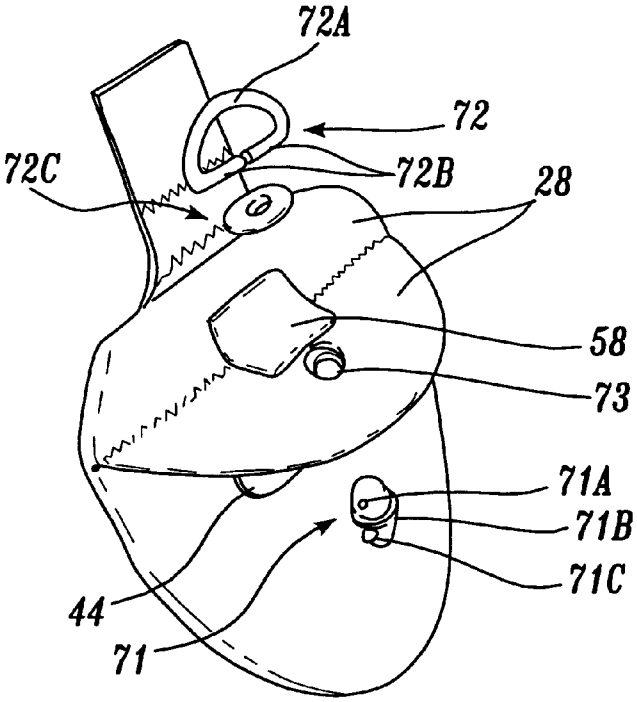
FIG. 13A is top perspective exploded view of the article container showing components of the second embodiment.

FIG. 2, a front perspective view of the preferred embodiment, shows container portion 22*a* comprising a receptacle, container, or pouch constructed from two flexible main sheets of material. A container front panel 30 and a container rear panel 48 are suitably cut to shape being overlaid one on the other and connected in some other way to each other along the vertical edges and bottom, thus forming a main container cavity between then Means of connecting panel 30 and panel 48 include, but are not limited to, stitching, gluing, welding, heat sealing, molding, grommeting and ultrasonic bonding. FIG. 2 also shows that, in the preferred embodiment, panel 30 and panel 48 are constructed as mirror images of one another along the vertical edges (sides) and bottom, however the upper portion of panel 30 and panel 48 will terminate in other named parts for different purposes, whereas panel 30 terminates in a clamp actuating hood, or container clamp interface flap 28. The top portion of panel 30, is folded outwardly upon itself forming a straight fold defining the boundary between front panel 30 and container clamp interface flap 28. FIGS. 2 and 13E, at each end of the straight bordering fold, show two secured corners, short angled darts or seams 28*a*. The terminal points or corners, at each end of the fold are creased inwardly, creating substantially downwardly angled termination points at either end. Darts 28*a* are formed by sewing or securing across these folds from the underside of container interface flap 28. Darts 28*a*, along with interface fold between panel 30 and flap 28, form geometry that exerts a biasing effect. This bias holds flap 28 substantially parallel to panel 30, as well as forms a hood or shallow pocket area on the underside of interface flap 28 where it folds to form front panel 30. Panels 30 and 48 are preferably made from elastic and cushioned material, such a neoprene, laminated rubber, or the like.

As shown in FIG. 2 of the preferred embodiment, the top portion of rear panel 48 is constructed with an elongated protrusion or extension forming a pocket closure extension 26. Fastened to the underside, or fabricated as part of extension 26 is a pull-apart fastening means 56. A clamp flap pull-apart fastening means 58 is affixed and positioned on the exterior of container flap 28 such that it is matched to affix and remain connected with fastening means 56 of extension 26. Suitable materials for fastening means 56 and 58 include, but are not limited to, hook and loop fasteners, snaps, buttons, hooks, zippers, tongue and groove, adhesive press tabs, magnetic closure devices, ties, loop straps, clips, turn button fastener, or any other suitable closure or fastening means.

As seen in FIG. 2 of the preferred embodiment, the interior of container rear panel 48, formed by the connection of panel 30 and panel 48, includes several elements. Pull-apart fastening means/flap 54 is connected or secured to the top edge of panel 48, at the base of extension 26 around the panel 48's top and sides. Fastening means/flap 54 runs the width of container portion 22*a*, (when container portion 22*a* is positioned upright). Flap 54 protrudes into the article cavity deep enough to provide its fastening means to come grippingly into connection with its fastening mate, as shown in FIG. 3.

Figure 3:
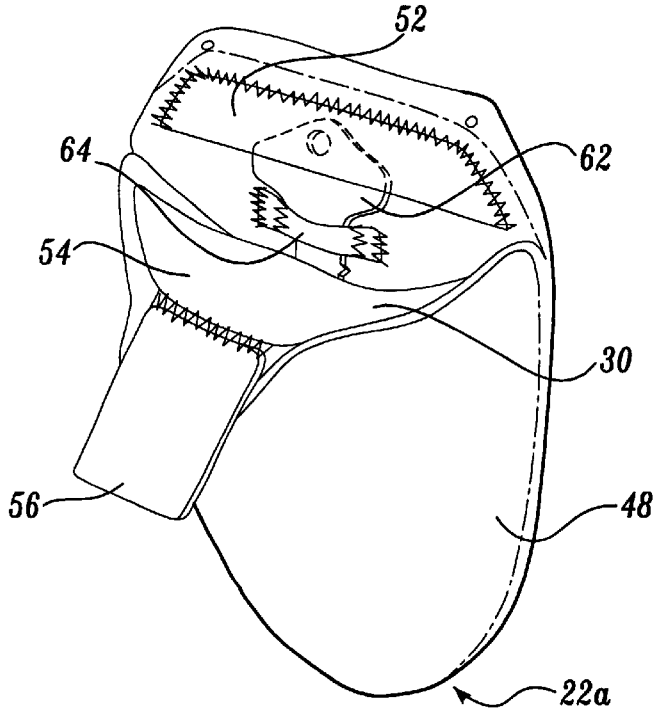
FIG. 3 is a rear perspective view showing the container article cavity in an open position.

FIG. 3, a rear perspective view of the preferred embodiment, also shows that panel 30 is constructed with several elements on its interior wall. Pull-apart fastening means 52 is the mating fastening means for attaching to fastening means 54. Fastening means 52 is connected or secured along its sides and top to the top edge of panel 30, runs the width of container portion 22*a*, and is connected to the interior wall of front panel 30. Fastening means 52 also protrudes into the article cavity deep enough to enable it to come grippingly into connection with mating fastening means 54. Suitable means of connecting fastening means 52 to the interior of panel 30, and connecting fastening means 54 to the interior of back panel 48 may include, but are not limited to, stitching, gluing, welding, heat sealing, molding, grommeting and ultrasonic bonding. Preferred materials, which may provide the multiple functions of flaps 52 and 54, may include, but are not limited to, flexible hook-and-loop sheet fasteners or other suitable fabric-backed or sheet fasteners. Although not preferred, snaps, zippers, or the like may also be used. Additionally, in the preferred embodiment, affixed to the interior wall of front panel 30, is key-retention means 64 as seen in FIG. 3. Retention means 64 comprises a suitably shaped piece of material affixed to the interior wall of panel 30. This may be constructed in the shape of a slim strip of material secured on both sides as illustrated in FIG. 3. Suitable means of affixing retention means 64 to container walls, include, but are not limited to, stitching, gluing, welding, heat sealing, molding, grommeting, and ultrasonic bonding. Suitable material for key-retention means 64 or the above retainment element may include, but is not limited to, rubber, plastic, metal, nylon, Lycra®, neoprene, PVC, polyethylene, polyurethane, leather, webbing, or any other natural or synthetic material that may be cut from sheeting, die cut, woven or molded.

Figure 6:
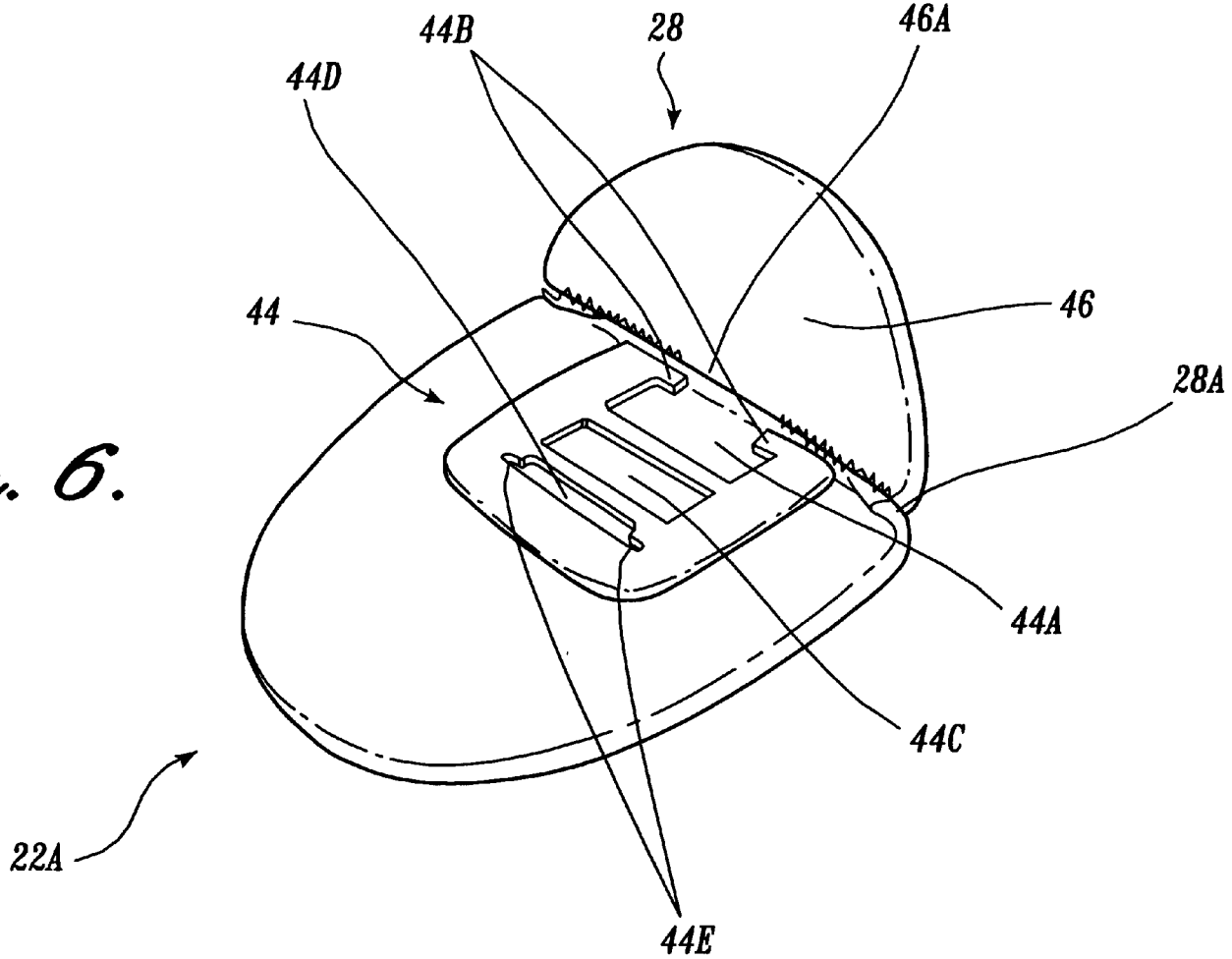
FIG. 6 is a perspective front view showing the holding clamp retention means.

As seen in FIG. 6 of the preferred embodiment, the underside of container clamp interface flap 28 includes clamp closing member retainer 46. Retainer 46 is approximately the size and shape of the underside of container clamp interface flap 28. Retainer 46 is connected to the underside of container clamp interface flap 28 on all sides except a portion in the center of the base edge of interface flap 28. This nonconnected area constitutes a closing member retainer opening 46*a*, which is sufficient in size and shape to accept and retain clip closing member 34 (FIG. 10) Means of attaching closing member retainer 46 to the inside of container clamp interface flap 28 may include, but are not limited to, stitching, gluing, welding, heat sealing, molding, grommeting weaving, ultrasonic bonding, and injection molding. Although a fairly flexible material is preferred, suitable materials for closing member retainer 46 include, but are not limited to, plastics, PVC, polyethylene, polyurethane, nylon, webbing, leather, metals, or any other suitable natural or synthetic material.

Holding Clamp Description—Preferred Embodiment

To enable the container portion to be releasably attached to any given carrier's clothing or the like, a holding clamp portion 22*b* is provided, the second main component of the preferred embodiment of the invention.

Figure 8:
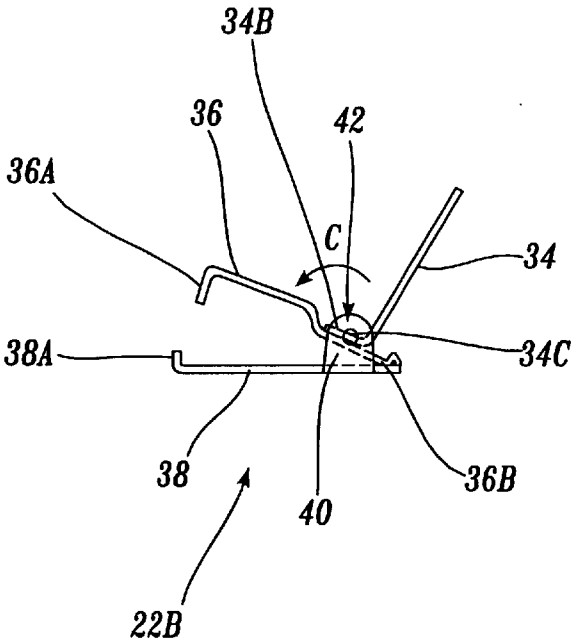
FIG. 8 is a side view of the holding clamp in an open position.
Figure 7:
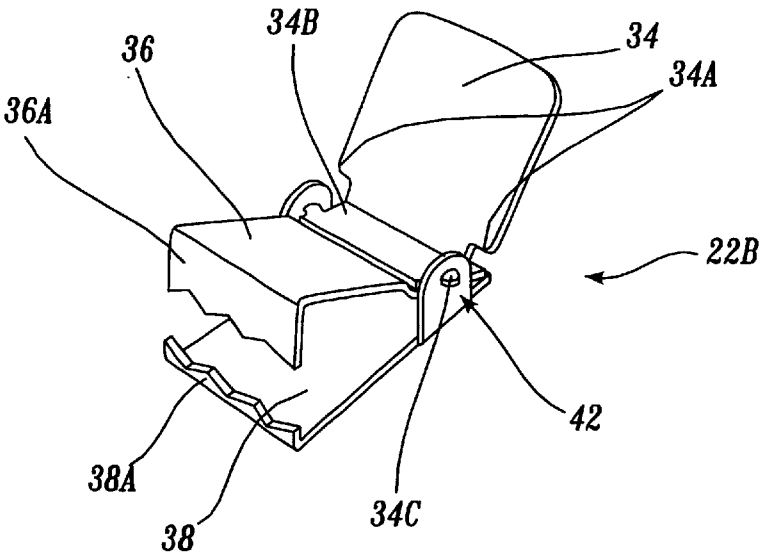
FIG. 7 is a top perspective view showing the holding clamp in an open position

In the preferred embodiment holding clamp 22*b* is based on a pivotally engaged overcenter cam lever biased locking clamp mechanism. FIG. 7 shows a preferred holding clamp 22*b*. Clamp 22*b* is constructed with a holding clamp closing member 34, holding clamp closing member hips 34*a*, and upper clamp 36, upper clamp teeth 36*a*, a lower clamp 38 and lower clamp teeth 38*a*. The lower clamp includes on each side a pair of opposed upstanding flanges 40, each with an opening 42. Upper clamp 36 is biased in the open position as shown in FIGS. 7 and 8. Closing member 34, in conjunction with closing member short leg 34*b*, acts as a lever when closing member 34 is actuated to close or compress upper clamp 36 toward lower clamp 38. Specifically, closing member 34 is pivotally engaged with lower clamp 38 via pins, shafts or closing member short leg projections 34*c*, which engage with flange openings 42.

FIG. 8 is a side view of the preferred embodiment, which shows that closing member 34 is substantially L-shaped in cross section, with a holding clamp closing member short leg 34*b* angled with respect to the longer leg portion, closing member 34. Pivoting the closing member short leg projections 34*c*, of closing member 34, about the openings 42, in the direction of arrow C, shown in FIG. 8, actuates leg 34*b* to engage upper clamp 36, maintaining the upper clamp 36 in a completely closed, maximum clamping or locked position. Closing member 34 is an overcenter clamp lever, which exerts a biasing force against upper clamp 36 in the closed position reversibly deforming upper clamp 36 to increase clamping force. Holding clamp 22*b* may be thus reversibly and selectively locked securely into the closed position when it is snapped closed.

As in FIGS. 7 and 8, upper clamp 36 and lower clamp 38, of the preferred embodiment, are provided with teeth, or frictional engagement means 36*a* and 38*a*, respectively, to provide frictional engagement for clothing and the like between the upper clamp teeth 36*a* and lower clamp teeth 38*a* and/or holding clamp retention plate 44 (described below). Suitable material for clamp portion 22*b* and its teeth, or frictional engagement means, may include, but is not limited to the following, either alone or in combination, metal, steel, plastic, rubber, thermoplastic, or other suitable natural or synthetic material. Suitable means of fabricating clamp 22*b* may include in total or in combination; molding, forming, slide tool fabrication, stamping and bending, extrusion or the like.

Figure 9A:
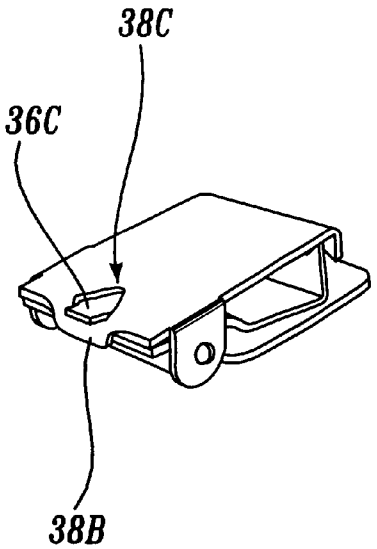
FIG. 9A is a bottom view of the holding clamp in a closed position.
Figure 9:
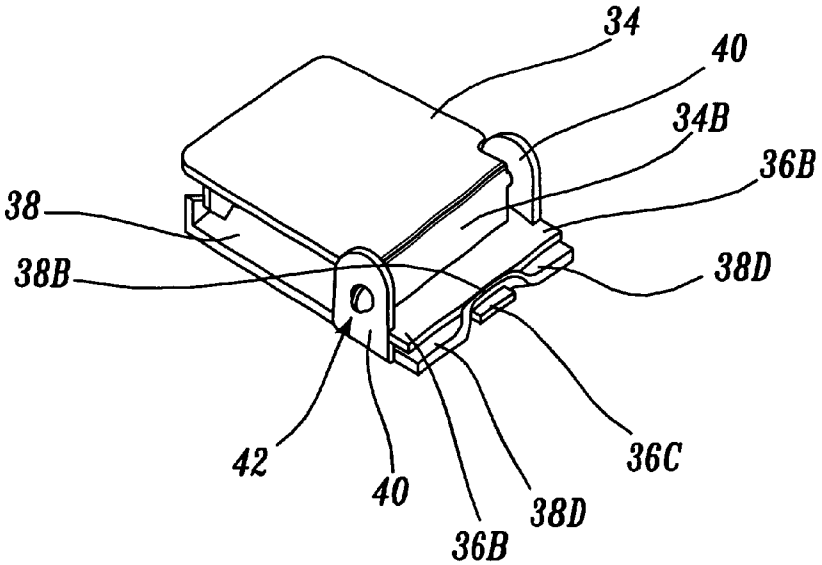
FIG. 9 is a top view of the holding clamp in a closed position.

FIG. 9 is a rear perspective view, of holding clamp 22*b*, showing additional details of the clamp. Lower clamp 38 is constructed of a flat base plate having teeth or frictional engagement means on one end and on the other rear end upwardly extending upstanding flanges 40 bent upward from the flat base plate of lower clamp 38, as shown in FIG. 9. These upstanding flanges, which are somewhat perpendicular to the flat base plate of lower clamp 38 on either side of the lower clamp 38, contain openings 42. The rear end of lower clamp 38 also includes an upwardly extending bent portion at the base end, retainment bend 38*b*, having a tongue retainment slot 38*c*. Tongue retainment slot 38*c* can be best seen from the underside perspective drawing in FIG. 9A In FIG. 9, holding clamp 22*b* also is constructed with upper clamp 36 having a declined rear portion, which terminates on the sides in upper clamp wings 36*b* and at the base end, a central projection or upper clamp retainment tongue 36*c*. Upper clamp retainment tongue 36*c* is received within tongue retainment slot 38*c* of retainment bend 38*b*.

Clamp Retention Plate Description—Preferred Embodiment

The third main element of the invention in the preferred embodiment is a clamp retention plate 44, shown in FIG. 6.

Figure 10A:
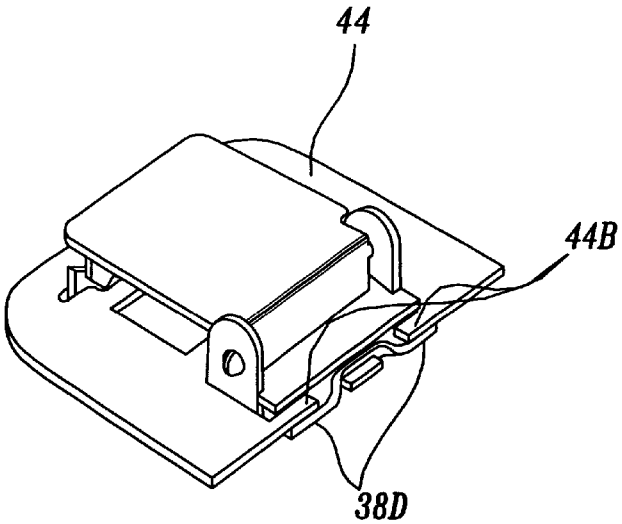
FIG. 10A is a rear perspective showing the holding clamp installed into the clip retention plate. (Retention plate is not connected to pouch panel for purposes of illustration).
Figure 10:
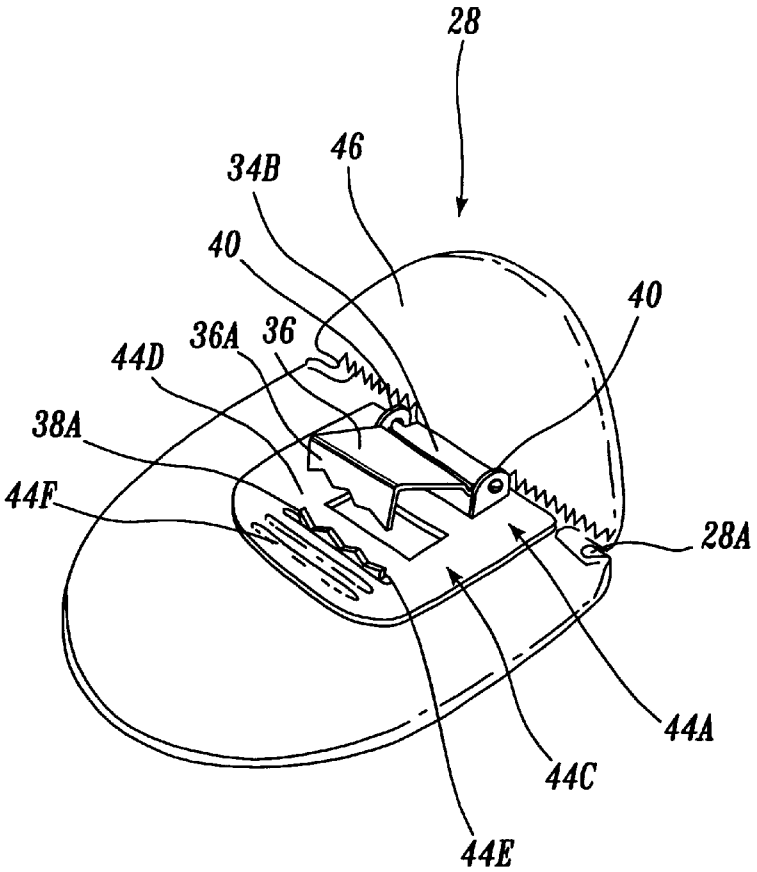
FIG. 10 is a front perspective view showing the holding clamp installed onto the article container.
Figure 10C:
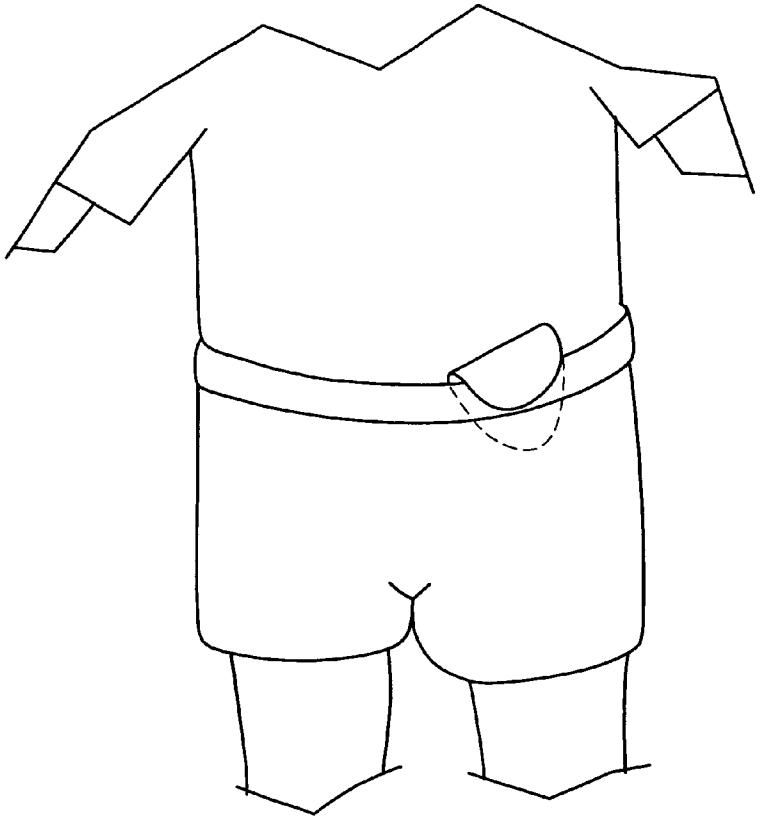
FIG. 10C is a front view illustrating problems that occur, in use, without preferred container darts.
Figure 10B:
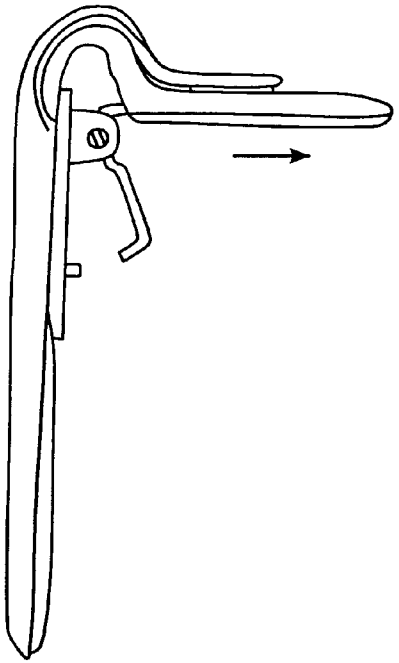
FIG. 10B is a side view illustrating problems that occur without preferred container darts.

Plate 44 provides for the permanent, removable or semipermanent attachment of clamp portion 22*b* to container portion 22*a*. Retention plate 44 is a molded, die-cut or otherwise suitably constructed plate that contains several cutout areas. Plate 44 is permanently attached on the vertical sides and base edge to container front panel 30 of container portion 22*a*. The top edge and center area of retention plate 44, where cuts in the plate's edge are positioned, is not affixed to container front panel 30. This allows positioning of holding clamp 22*b* (described below) between the clamp retention plate 44 and container front panel 30, as seen in FIG. 10. The means of attaching the perimeter areas of clamp retention plate 44 to container front panel 30 include, but are not limited to, stitching, gluing, welding, heat sealing, molding, grommeting and ultrasonic bonding. Suitable materials for clamp retention plate 44 include, but are not limited to, flexible, semiflexible or rigid plastics, metals, thermoplastic elastomer, rubber, textured sheet plastics either in sheet or injection molding states. These materials may be used alone or in combination to produce plate 44.

Figure 15A:
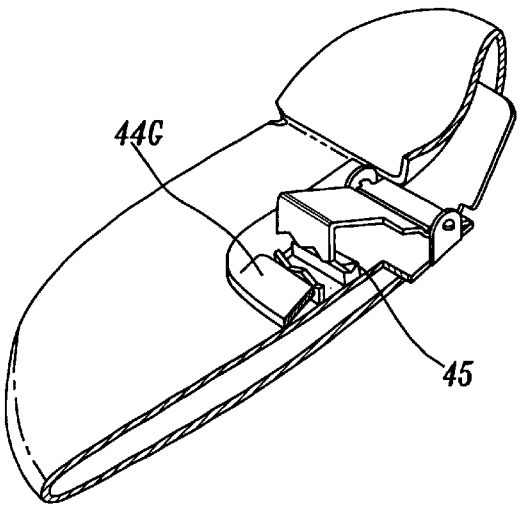
FIG. 15A is a top perspective cutout cross-sectional view of the invention showing the retention plate feed-in ramp.

Also, as seen in FIG. 6, clamp retention plate 44 contains several cutout areas. These include a retention plate "U" cut 44*a*, a plate projection 44*b*, a plate cut 44*c*, a plate cut 44*d*, and retention plate cut indents 44*e*. Each is cut to shapes and sizes to receive and retain corresponding parts of clamp 22*b* as shown inserted under plate 44 in FIG. 10. Additional elements to retention plate 44 are shown more closely in FIGS. 15 and 15A Plate thumb gripper 44*f* ridges are formed into a small ramp, feed-in ramp 44*g* on plate 44. Ramp 44*g* begins flush with plate 44 at the base end of plate 44 and terminates in its highest point at the base of plate cut 44*e*. Thumb gripper 44*f* and retention plate feed-in ramp 44*g* are preferably injection molded or are otherwise suitably formed into plate 44 itself; however, these elements may obviously be fabricated separate from the plate and attached via rivets, glue, bonding or via other suitable means.

Figure 11A:
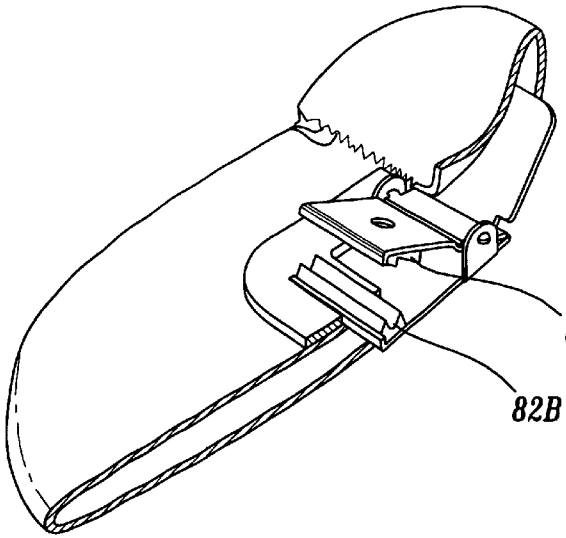
FIG. 11A is a cross section along line 21—21 of FIG. 4 with the holding clamp shown in the fully open position showing an alternative clamp teeth configuration.
Figure 11B:
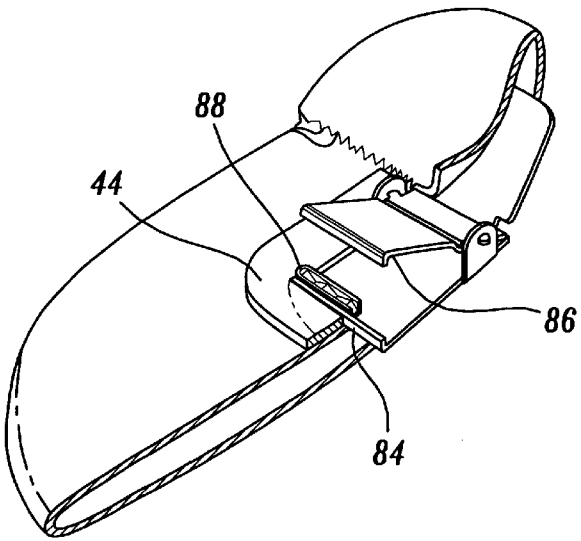
FIG. 11B is a cross section along line 21—21 of FIG. 4 with the holding clamp shown in the fully open position showing an alternative clamp teeth configuration.
Figure 11:
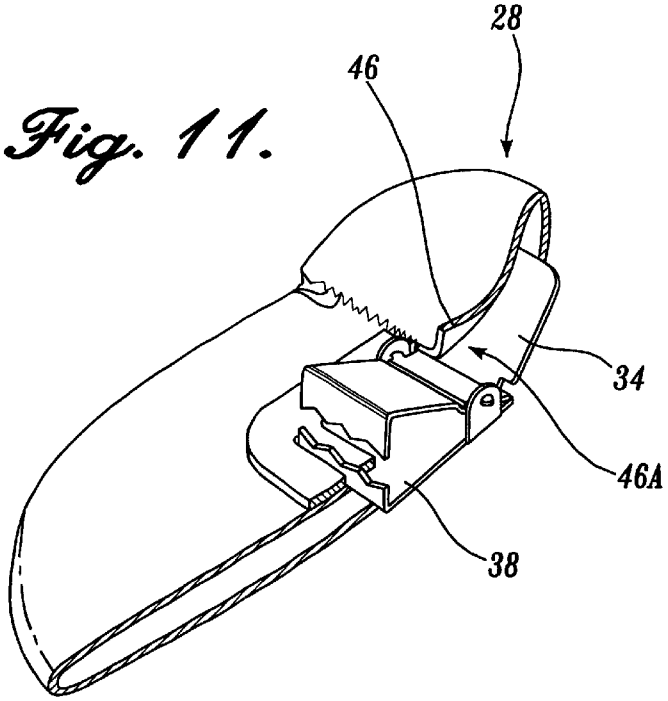
FIG. 11 shows a cross section along line 21—21 of FIG. 4 with the holding clamp shown in the fully open position

As can be seen in FIG. 10, in the preferred embodiment, the lower portion of holding clamp 22*b*, lower clamp 38, shown earlier in FIGS. 7 and 8, is installed permanently or semipermanently between clip retention plate 44 and container front panel 30. Lower clamp 38 rests parallel to, and is sandwiched between, the exterior of container front panel 30 and the bottom or underside of clip retention plate 44. Once plate 44 is connected as described to container 22*a*, installation of clamp 22*b* to container 22*a* via plate 44 may be achieved, as shown in FIGS. 10, 10A and 11. Staring with clamp 22*b* in an open position, (mouth open), holding clamp plate 38 is inserted teeth first into cut 44*a* of plate 44. Clamp plate 38 is inserted until the teeth or frictional engagement means 38*a* protrude or rest under plate cut 44*e*. In this position, both upstanding flanges 40 snugly fit perpendicular to the sides of plate "U" cut 44*a*. Plate "U" cut projections 44*b* (FIG. 10A) wrap around the sides and to the backside of upstanding flanges 40 and rest flat upon lower clamp projection rests 38*d*. The middle flat area of lower clamp 38 can be seen lying flat against container front panel 30 through plate cut 44*c* (FIG. 10). The top edge or points of lower clamp teeth 38*a* rest, either covered in a premolded channel in the corresponding location on the underside of plate 44, or actually protrude through plate cut 44*d* as shown in FIG. 10.

As shown in FIG. 6, plate cut 44*d* has two parallel channel areas within its opening. FIG. 10 further illustrates that one channel or opening is closer to the base end of clip retention plate 44 and is the area or thin channel formed between plate cut indents 44*e* of plate cut 44*d*. This channel area receives lower clamp teeth 38*a*, when clamp 22*b* is inserted under plate 44. The second area or parallel opening channel directly behind the channel in which teeth 38*a* may reside, is sized and shaped as to accept upper clamp teeth 36*a* or frictional engagement means when the clamp is actuated to rest in its closed position. Plate cut 44*c* is a cutout area between plate cuts 44*a* and 44*d* whose relative location is shown, but whose function is later described.

As shown in FIG. 11 of the preferred embodiment, clamp closing member 34 is inserted into closing member retainer opening 46*a*. Closing member 34 rests inside opening 46*a*, between the inside base portion of container clamp interface flap 28 and base edge of closing member retainer 46. Flap 28 fits over closing member hips 34*a*, thus retaining the closing member 34 in the installed position. Closing member retainer opening 46*a* is positioned snugly around closing member hips 34*a* and against the upper bend or upper edge of closing member short leg 34*b*.

Figure 12A:
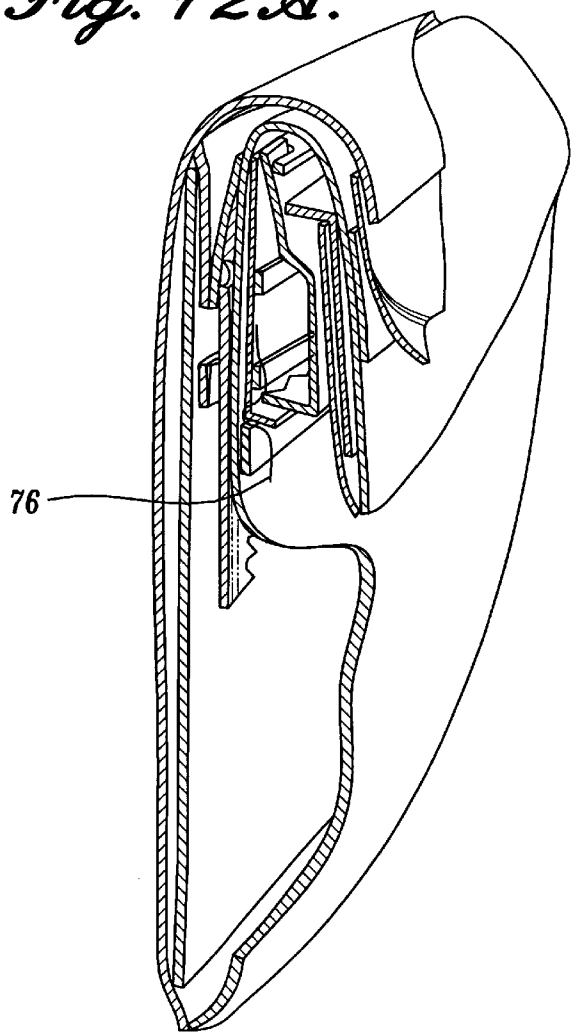
FIG. 12A is a cross section, as shown in FIG. 12, with a line showing the labyrinth path of the material engaged in the holding clamp when it is closed.
Figure 12:
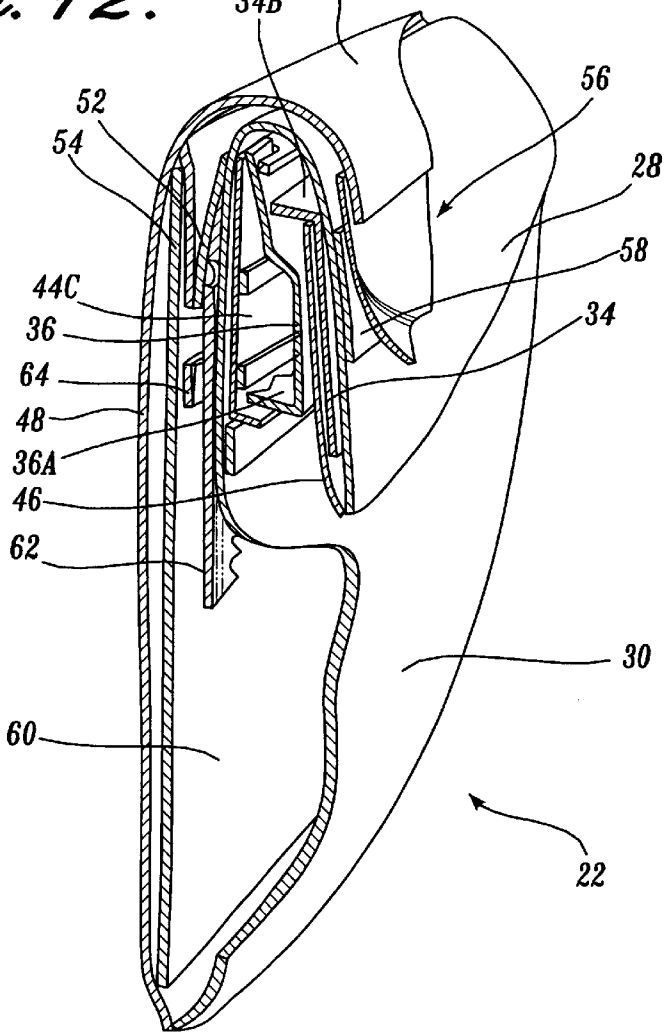
FIG. 12 is a cross section along line 21—21 of FIG. 4 with a portion cut away to show credit card and key.

FIG. 12 provides a cross-sectional view of clipable article container 22 assembled in its clamped or closed position with a portion cutaway. Elements are included of both container portion 22*a* and holding clamp portion 22*b* of the preferred embodiment, as well as a retained key and credit card for illustration. FIG. 12A shows a labyrinth path 76 of the material engaged in the holding clamp when it is closed.

Variations to Preferred Embodiment Description

Figure 14:
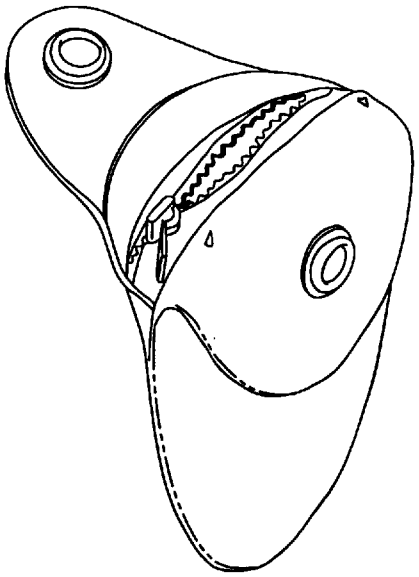
FIG. 14 is a perspective view of the container showing a zipper closure and snap closure variations.
Figure 14A:
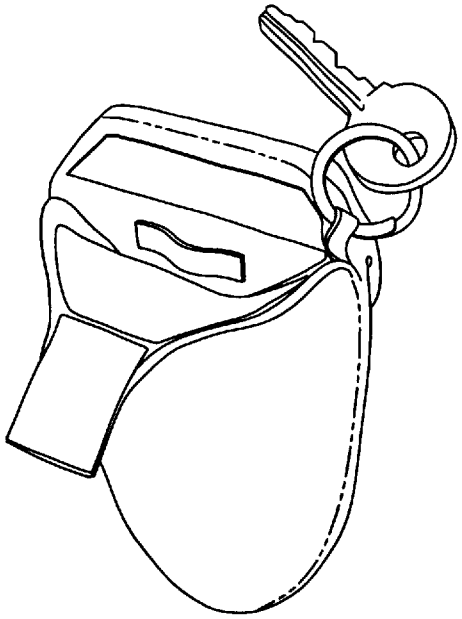
FIG. 14A is a perspective rear view of the open container showing a keying feature variation.
Figure 14B:
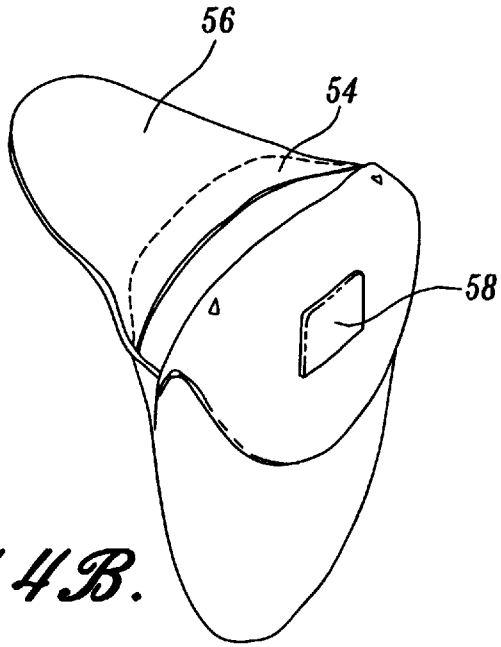
FIG. 14B is a front perspective view of an alternative cavity closure configuration while showing the article cavity in an open position.

It should also be appreciated that various elements of all embodiments of the invention may be changed or modified without departing from the spirit of the invention. For example, the container portion or parts thereof may be constructed of any semirigid or hard materials, molded, formed or cast. Exterior portions for example, could be molded in character forms such as animals. Container cavities and closure flaps may be shaped as desired of flexible or rigid forms. Any number of cavities may be added to the container using flexible or hard materials, as desired. Dividing container or clamp elements into separate parts or from separate parts into integrally affixed pieces or one-piece construction may be desirable for enhancing specific functions. One example of this is shown in FIG. 14B, which combines fastening means 56 and 54 into one part. In FIG. 14B, fastening means 54, 56, and 58 are formed of mating hook-and-loop strips. Also, portions of the clamp and plate can be molded as one. Obvious additions may be made to the container in the form of various attachments or pocket means for specific item retainment such as: a keyring attachment or the like, as shown in FIG. 14A, mesh panels or pockets, etc. Secondary attachment means of the invention to the user may be provided including a tether to secure the invention to a belt loop or backpack, and a belt loop may be sewn into the outside panel of the container to allow secondary or optional attachment to a belt in this manner. Useful devices may be contained inside or incorporated into the container such as a pager, stopwatch, timer, recorder or computer, either permanently or removably, via a pocket with a viewing window, or other obvious retainment means.

Similarly, variations relating to the clamp and plate elements of the invention may be incorporated for special purposes as follows:

Various clamp edge or upper and lower teeth configurations of the preferred over-biased style holding clamp may be utilized providing adequate and forceful frictional engagement and effective clamping action when engaged onto clothing of the user and the like.

As long as the top edge or teeth of the clamp press the engaged fabric into the plate or bottom clamp area, when the clamp is closed, virtually any construction combination of one- or two-part teeth or friction-adding elements to either the plate or clamp is acceptable. For example, the teeth shown in FIG. 11A on the clamp are achieved in this design by being molded into two plates 82*a*, 82*b* as illustrated. These plates are then affixed via riveting, bonding, gluing, or being molded onto the inside of the upper and lower clamp panels. Alternatively, teeth or fiction-enhancing forms may be molded in any shape into the clamp retention plate to enhance secure gripping action. An example of this is shown in FIG. 11B. The bottom clamp teeth or rim 84 are molded into or protrude into the underside of plate 44, further securing the clamp to the plate. The upper clamp teeth 86 terminate in a single unserrated edge and when actuated force the sandwiched fabric between itself and the friction-enhancing serrations or forms 88 of plate 44. These plate teeth or friction-enhancing forms may also be made in one piece with the upper and/or lower clamp panels by being molded or formed as one piece. Preferred materials for fabricating this clamp/teeth configuration are metal, plastic, or other suitable materials.

Within the spirit of the invention, as an alternative to inserting holding clamp 32 inside plate 44*a* as indicated in the preferred embodiment, holding clamp 32 may alternatively be affixed directly to container front panel 30, of container portion 22*a* via other means. These include grommeting or bonding the base of the holding clamp directly onto a plate (with or without cuts), which is either on the outside of the container, as is the case with plate 44, or to a plate on the inside of the container in which the grommets or the like attach the clamp to the plate through the fabric of the container. Additionally, the clamp or clip portion may be retained on the container portion via other means such as simply bonding, sewing, or riveting or the like, any suitable portion of the clamp portion of the invention to the container portion directly (without a plate element). Other suitable clamp retainment means may be used provided that the clamp is securely retained on the container, as intended, and has the ability to securely engage clothing and the like.

Although the actuating area of closing member 34 is pictured in a square shape in FIG. 7, it may be made in other shapes, such as a half-circle, round, etc. and still function as intended in an overcenter cam style clamp as described in the preferred embodiment. Similarly, the upper and lower clamps (36 and 38) of the clamp 22*b* may be made in other suitable shapes, such as fanned out or tapered from the tip to the base, to house a wider toothed area and the like. Other elements of the preferred clamp may be modified in this way as desired for special purposes or distinct features. Also, although not preferred, within the spirit of the invention, other styles of overcenter locking clips can be incorporated into the novel design, depending on the specific needs and intended use of the container and product. Other style clips that can simply be integrated into the existing novel design include overcenter, two-position, clamshell alligator style, and slide-on "U" style clipping mechanisms.

From the description above, a number of advantages of the clipable article container become evident:

Security Advantages

In this respect, the device disclosed herein differs from heretofore available releasably attachable article receptacles in that it provides a combination of novel and superior security components. First it provides superior means of securely clamping the container to the user. Secondly, it provides novel cavity closure components and configuration ensuring more secure containment of articles once they are placed inside the container's cavity for carrying. The clamping mechanism preferred attains a superior, highly leveraged clamping and true locking force on items to which it is clamped. Additionally, the container or cavity portion of the invention intended for the safekeeping of articles is constructed with multiple cavity-closure components, providing a superior means of safely holding items inside the cavity without fear of loss. Alternatively, the clip may employ an additional locking mechanism for secondary clamp locking means.

Clip Retainment Plate Advantages

Also significant in the invention is the novel clip retainment plate element that in its preferred form provides the following; it enables the clamp to be securely and removably attached to the container portion based upon its strategic voids for receiving the clamp, it incorporates a feed-in ramp for easy insertion of fabric into the mouth of the clamp, it contains a specific area and grippers that aid in gaining leverage in using the plate to quickly and easily open the clamp, it spreads the weight load of container contents over a wider surface area when the invention is in use, its configuration in conjunction with the clamp, forces the clamped fabric into a labyrinth configuration for further holding effectiveness; finally, it provides teeth or additional frictional engagement qualities to aid in secure clamping effectiveness.

Container Advantages

The container portion of the present invention is constructed to include components that contribute and maize the comfortable and effective use of the invention Thus, the container portion is preferably constructed using a flexible and cushioned material, for example, neoprene or laminated rubber, such that articles contained therein cannot poke or jab the user, especially when worn inside a waistband. Additionally, these qualities of the material of the container provide that the movement of the user is not limited or uncomfortable and permits the container to hold items that are sized or shaped differently than itself Alternatively, the container may be waterproofed or provide for a waterproof compartment inside. It is also preferred, and novel, that a clip hood, cover, or flap is formed into the front panel of the container portion that covers and hides the clip from plain view and doubles to provide comfortable and effective means of opening and closing the clamp component. Due to the way in which the actuating member of the clip is retained inside the container's hood or flap element, a comfortable two-sided gripping surface, leveraged clip opening, and a broader surface to actuate the clip are provided. Darts, at each side of the clip hood or cover, form a natural bias and aid in keeping the clip-actuating part inside the hood, whether the clip is in an open or closed position and importantly ensures that the invention, when worn on a waistband will not accidentally be positioned askew and look cockeyed relative to the horizontal plane of the waistband.

Additionally, preferred in the current invention is a flap that is formed from the back wall of the container and contributes at least three novel features to the invention. First it wraps over and acts to provide a cover to the article cavity opening, it provides a second fastening Closure to this cavity; and, thirdly, when the flap is unfastened to insert or retrieve articles to and from the cavity, it acts as a funnel or guide providing easier, quicker, one-handed, and no-looking-required access to the items contained. Importantly, the combination of the clip mechanism and the way in which it is integrated into the container portion's elements enable the user to clamp on, load and unload, and remove the invention with one hand, whereas most other attempted solutions require two hands, more time, and attention to use. Additionally, for convenience, items may be retained against a wall or orientated inside the container cavity using pockets, flaps or other article-retaining features.

Manufacturing Efficiency Advantages

The novel construction and components of the present invention also allow it to be easily, cost effectively, and flexibly manufactured. The clip and plate components require minimal and inexpensive tooling, if any, and are simple, inexpensive, and require a minimum of operations to construct. Also, the invention is constructed to allow flexibility in manufacturing and assembly and thus offers more efficiency. For example, due to design of the components, the clip retention plate may be sewn onto the container or pouch in one location such as a bag maker, and then the clip installed into the plate as a final production step in the same location. Or, the pouch with the plate may be completed and stored for the option of later installing the clip on an as-needed basis.

In addition, the present invention is simple and the components and features are well integrated, providing an optimal combination of elements for carrying or portably containing items safely in a highly convenient, comfortable, and efficient manner.

Versatility Advantages

Furthermore, the invention disclosed herein is highly versatile, improving upon some disadvantages of the heretofore known disclosures in the following areas. The current invention may be attached to a variety of items made of various materials from thick and thin to delicate. It is not required to be oriented in any specific position on the user, their clothing, or restricted to using on ones person. For example, it may be attached frontwards or backwards, upside-down, inside or outside a waistband. It lends itself to use during sports and/or leisure activities. It may be viably used without clamping it, as a conventional wallet or coin purse. It may be worn in either a concealed or unconcealed manner. It enables the user to load or unload items into the container before or after clipping it on.

Operation—Preferred Embodiment

When not in use clipable article container 22 is generally stored as a semiflat receptacle, since there are no articles inside, with the clamping mechanism resting in its closed position.

In operation, the clipable article container described above is used and functions as follows. One may begin use of the article container by either locking it first with items to be carried or contained in container 22*a* and then it may be secured or attached, if desired, to an article of clothing or the like. The alternative is to first attach the invention, if desired, to an article of clothing or the like and then load it with the items the user intends to carry or contain.

Figure 15:
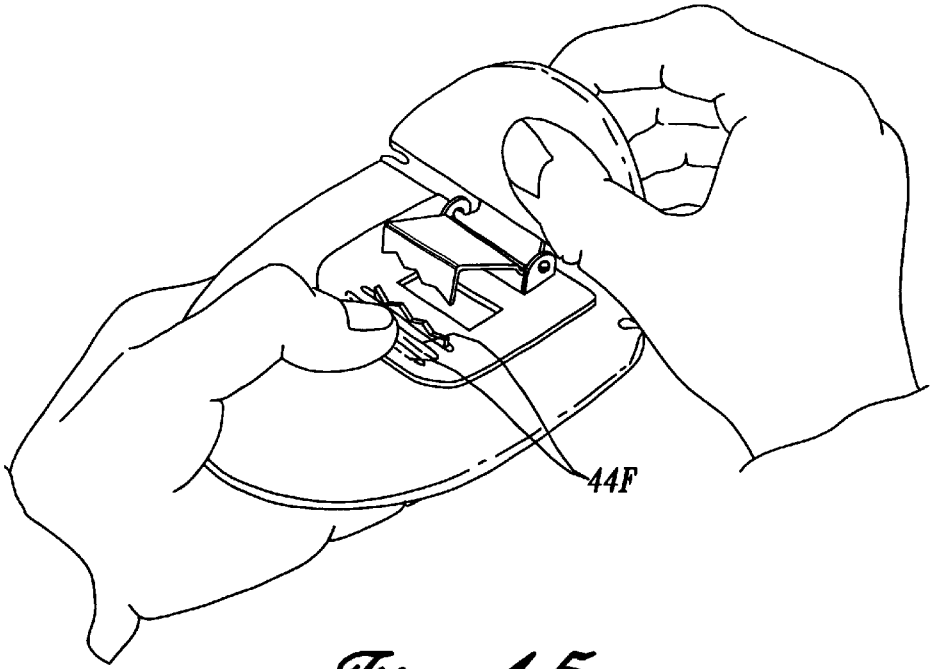
FIG. 15 is a top perspective view showing the retention plate thumb gripper and clamp opening action of the preferred embodiment.
Figure 16A:
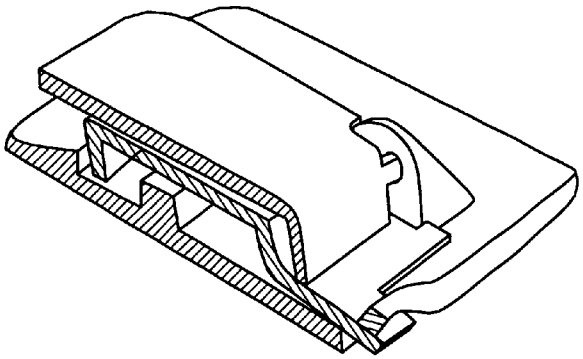
FIG. 16A is a cross section view of an alternative embodiment of the invention showing a one-piece lower clamp and plate
Figure 16:
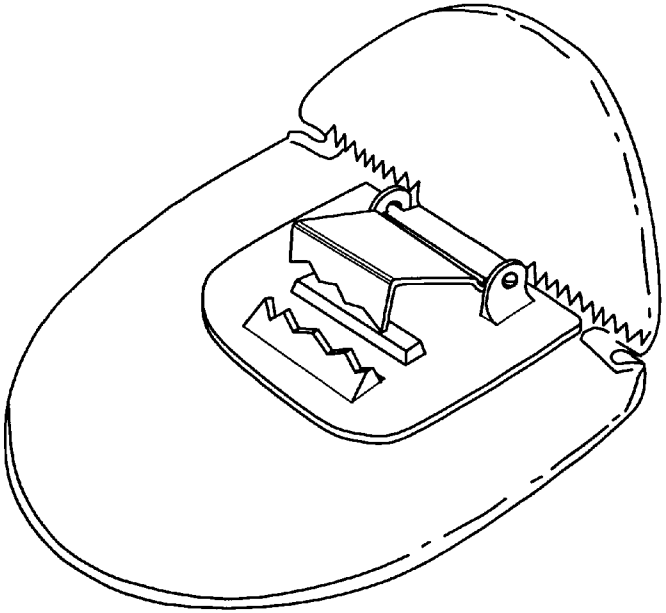
FIG. 16 is a front perspective view of an alternative embodiment showing a one-piece lower clamp and plate connected to the container.

To attach the article container 22 either preloaded with articles or with the intention of inserting articles into the container once it is attached, clipable article container is held in one of the user's hands, the other hand is used to pull up or open interface flap 28. The thumb of the hand holding the clipable article container 22 may, for ease of opening, be placed just under flap 28 at the base of plate 44 on plate thumb gripper 44*f* and retention plate feed-in ramp 44*g*, while the other hand is used to pull open both flap 28 and closing member 34, which is contained inside flap 28. This action is illustrated in FIG. 15.

In this open position, interface flap 28 is positioned somewhat perpendicular to container front panel 30 as shown in FIG. 10. Because interface flap 28 houses closing member 34 (FIG. 11), when interface flap 28 is pulled up to its open position, closing member 34 is pulled up, thus opening or allowing upper clamp 36 and lower clamp 38 to spring open to their normally open biased position. This open position, described for both interface flap 28 and holding clamp 22*b*, is shown clearly in FIG. 10. With the holding clamp 22*b* in this open position, the user can introduce the edge or portion of any article that may be inserted between the upper and lower clamp including, but not limited to, items such as any clothing, a swimsuit waistband, belt, pocket edge, shirt pocket flap, bag strap, backpack, and the like.

As described earlier, the fabric or an element of the article being inserted into the mouth of the clamp is slid along retention plate 44 and up plate feed-in ramp 44*g* (FIG. 15A) assisted by its incline into the mouth of the clamp. Once the article is inserted into the open mouth of holding clamp 22*b*, clamp interface flap 28, and thus closing member 34, is pushed down in an overcenter biased position until it stops in its fully closed or locked position It can thus be seen that the closing member 34 functions as an overcenter clamp lever, which exerts a biasing force against upper clamp 36 in the closed position, reversibly deforming upper clamp 36 to increase clamping force. The holding clamp is reversibly locked into the closed position when it is snapped closed. Once article container 22*b* is clamp-locked onto an article of clothing or the like, articles may be introduced into the main cavity area of article container 22 for secure keeping.

The introduction and safekeeping of articles inside the article container is achieved as follows when the article container is in its clamp-locked position onto an article of clothing or the like or held in a user's hands prior to attachment. First, pocket closure extension 26 is pulled up (FIG. 2) to its unengaged or open position. Then, as shown in FIG. 3, pull-apart fastening means and flap 54 and pull-apart fastening means 52 are pulled apart and unengaged to open the top of the main cavity of the container. Any type of items, such as those described earlier can then be inserted into the open cavity of the article container. Pull-apart fastening means/flap 54 and pull-apart fastening means 52 are pressed together to a fully fastened position.

Pocket closure extension 26 is pulled over the top edge of interface 28 and secured by the pressing engagement of pull-apart fastening means 56 and pull-apart fastening means 58.

Figure 1A:
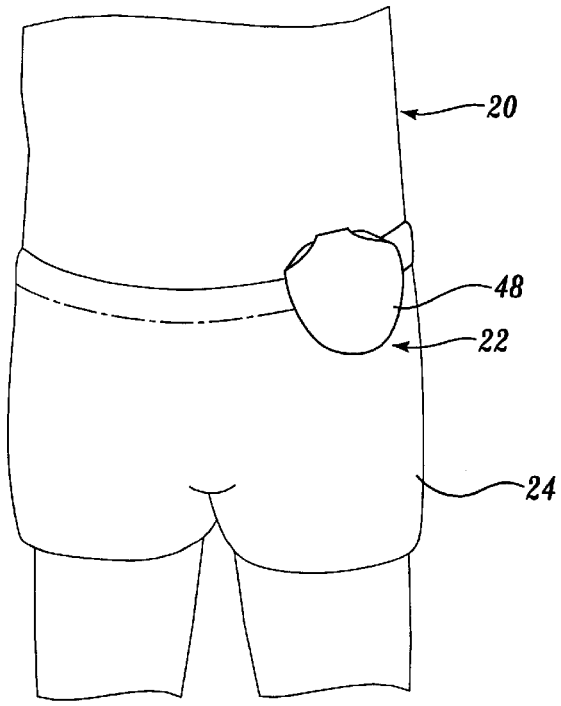
FIG. 1A is a rear view of the present invention, attached in another position to a waistband.

Uniquely, clipable article container 22 can be clipped to clothing or the like in any way desired for use of containing articles. However in FIGS. 1 and 1A, typical use of the invention on pants, shorts, or any article of clothing with a waistband is illustrated. FIG. 1 shows clipable article container 22 clipped to a waistband of shorts in a position such that front container panel 30 (FIG. 4) of the container portion lies against or faces the inside of the wearer's clothing (not the wearer) and the outside of container clamp interface flap 28 is visible or shows to one looking at a front view of the wearer, whereas back panel 48 faces the wearer's body. Therefore, in this position, the main cavity for holding articles in clipable article container 22 is sandwiched between the wearer and the inside panel of the wearer's clothing or undergarments. This provides an inconspicuous positioning of the article container. The preferred cushioned container construction provides cushioning between articles in the container and the wearer. Its preferred elasticity permits the container to accept articles that are shaped and sized differently than itself Articles can be placed inside the container 22 while it is either clipped in position on the user or the like, or held in one's hand prior to or after clipping to clothing, another article, or the like, for use. Alternatively, FIG. 1A shows clipable article container 22 clipped in another, typical use of the invention on pants, shorts, or any article of clothing with a waistband, positioned such that front container panel 30 (FIG. 4) of the container portion lies against or faces the outside of the wearer's clothing (facing the wearer) and the outside of container clamp interface flap 28 is not visible, but faces the wearer on the inside of the waistband. In this case, container rear panel 48 (exterior) would be visible to one looking at a front view of the wearer and front panel 30 faces the outside of the wearer's clothing. Therefore, in this position, the main cavity for holding articles in clipable article container 22 lies on the outside panel of the wearers clothing. Articles can be placed inside the container 22 while it is either clipped in position on the user or the like, or held in one's hand prior or after clipping to clothing, another article, or the like, for use. As suggested earlier, article container 22 may be clamped onto anything that clamp 22*b* can engage to a final closed (closed biased) position. It can also be clamped in any position (to any item) and still contain the items stored inside as intended.

Although a preferred embodiment of the invention has been described above, it should be understood that the invention is not limited to the particular embodiment described. Thus, the following additional embodiments and variations are described and illustrated.

Description of Second Embodiment

Figure 13:
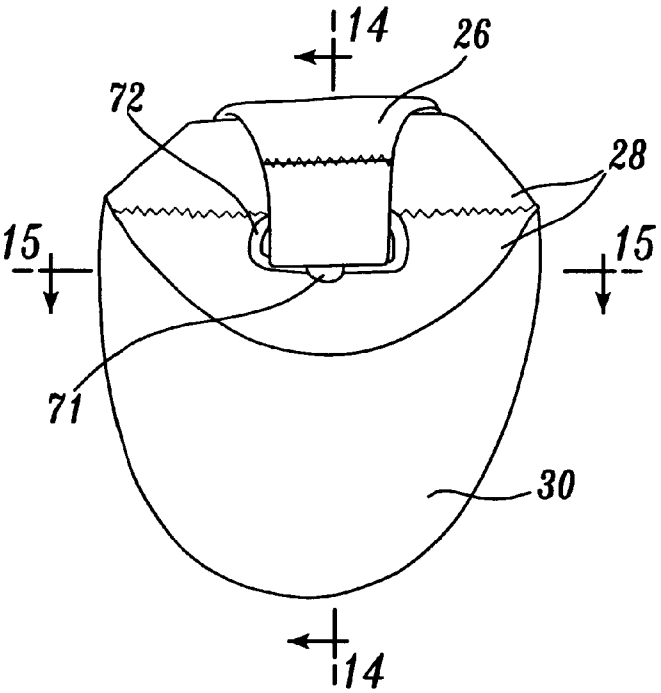
FIG. 13 is a front view of the article container of the second embodiment.
Figure 13B:
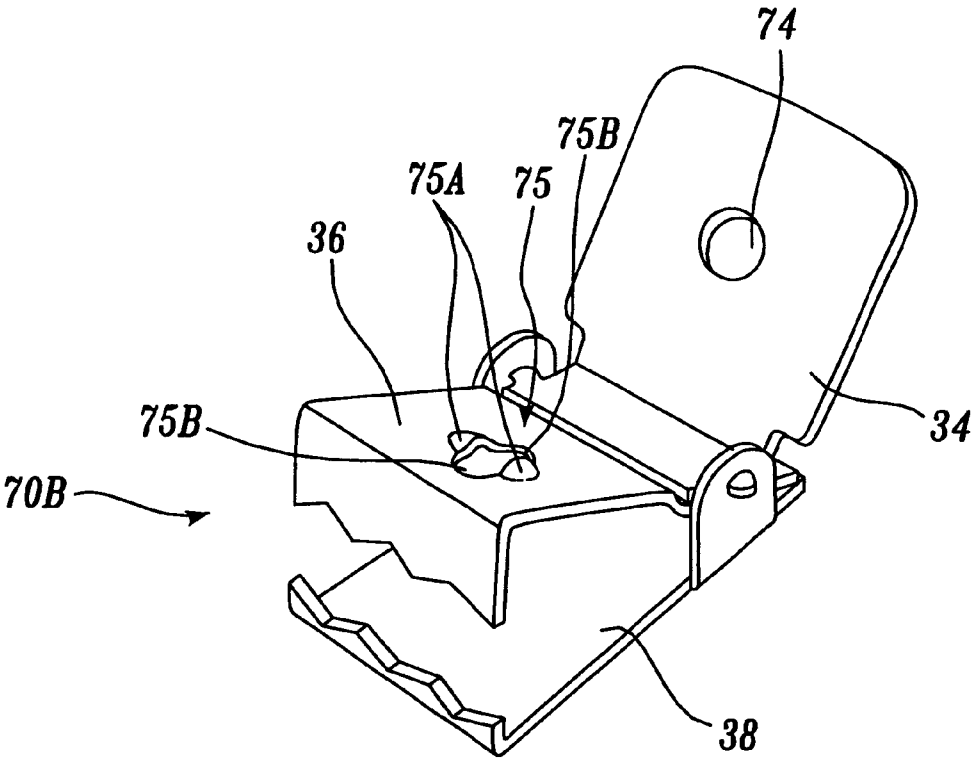
FIG. 13B is a top perspective view of the holding clamp of the second embodiment.
Figure 13D:
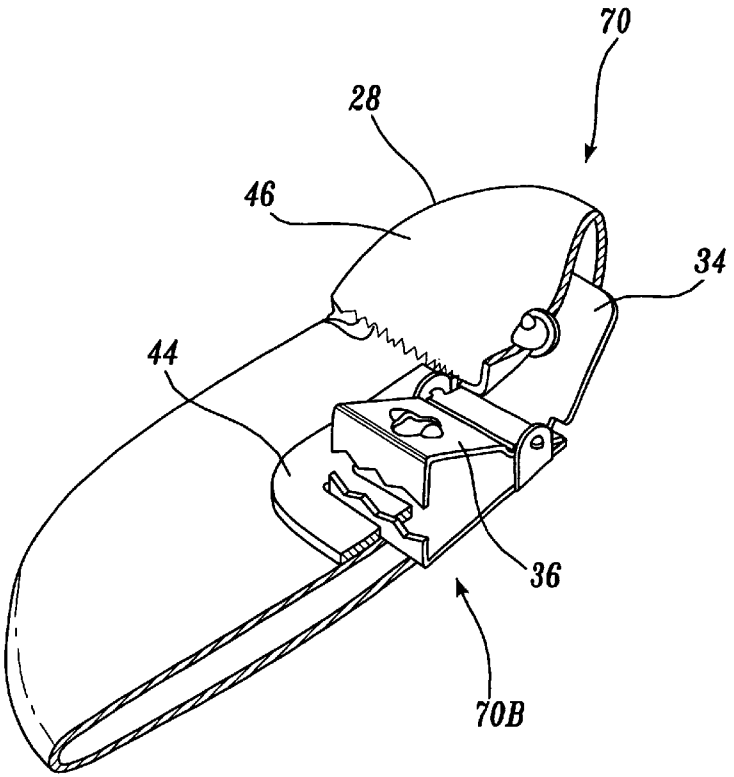
FIG. 13D is a cross section of the second embodiment, taken along line 14—14 of FIG. 13 with the holding clamp shown in full.
Figure 13C:
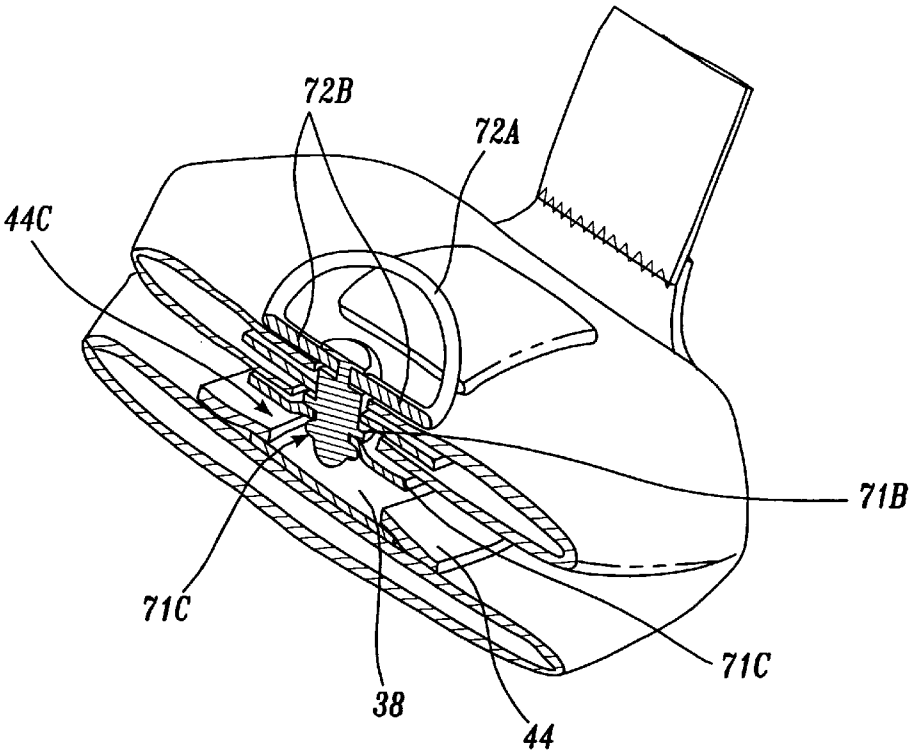
FIG. 13C is a cross section of the second embodiment, taken along line 15—15 of FIG. 13.
Figure 13F:
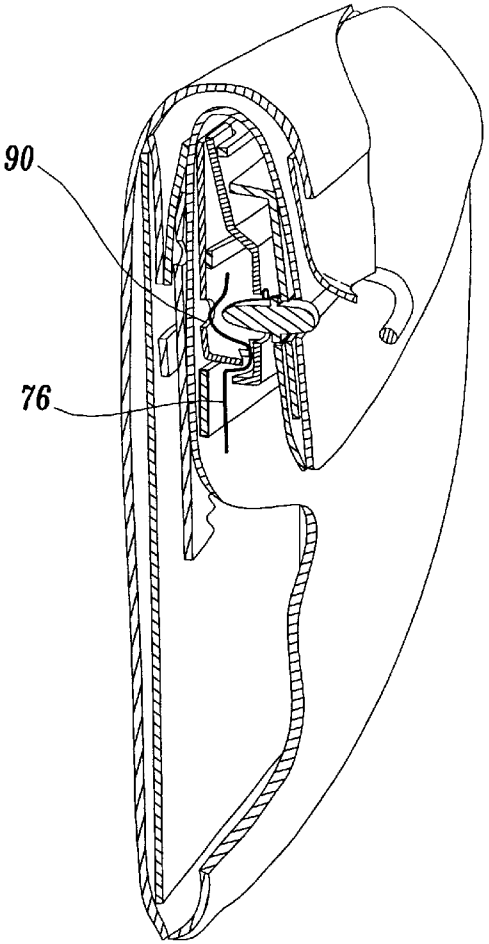
FIG. 13F is a cross section along line 14—14 of FIG. 13, of the second embodiment, showing the labyrinth path of the material engaged in the holding clamp when closed.
Figure 13E:
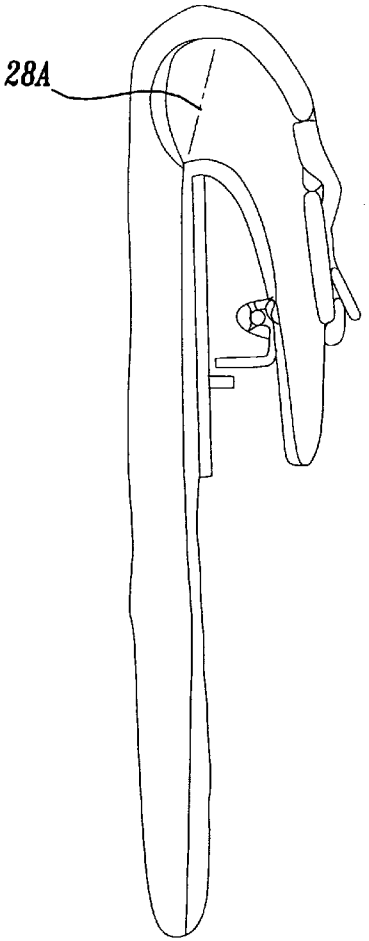
FIG. 13E is a side view of the second embodiment, seen in FIG. 13.

As shown in FIGS. 13–13E, the second embodiment 70 of the present invention is identical to the first embodiment except for the addition of elements to the container and clamp portions that provide additional or secondary clamp locking means to the container and holding clamp. FIG. 13A, in an exploded view, introduces the two main additional elements, of the second embodiment, a locking pivot 71 and a latch handle 72 and their connecting parts.

Locking pivot 71 is a solid pin-type element, which is made of three parts or areas. The upper half of pivot 71 and the lower half of pivot 71 are separated in the center by locking pivot ring 71*b*, which is a permanently fixed ring element around the belly or midsection of pivot 71. On the upper half of pivot 71, above pivot ring 71*b*, there are two pivot holes 71*a* on opposing sides of pivot 71 that extend toward each other as deep as possible toward the core or center of the pivot but are separated in the middle by a solid wall or plate. On the lower half of pivot 71, below pivot ring 71*b*, on opposing sides, there are two locking pivot projections 71*c* or bump-like protrusions. Alternative configurations may replace pivot projections 71*c* with screwtype flanges, threads, or the like to achieve the primary desired result of allowing closing member 34 to be locked, secured, or screwed to upper clamp 36 to provide the double locking security means and provide that upper clamp 36 is fitted with the appropriate mating aperture projection receiving elements. Materials for locking pivot include, but are not limited to, plastics, metals or other suitable rigid or semirigid materials. Pivot 71 parts may be molded, cast, or otherwise fabricated.

As also seen in FIG. 13A, there is a hole made through three elements forming three flap holes 73 that are designed and positioned to accept locking pivot 71. Flap holes 73 are round holes cut, ultrasonically formed, punched, routed, bored, burned, or the like all the way through the midsection of container clamp interface flap 28, closing member 34 and closing member retainer 46. This provides that the pivot may proceed through all three holes and thus visibly protrude to the exterior of interface flap 28 when inserted. Flap holes 73 are of a suitable size to accept locking pivot 71.

FIG. 13A also shows the second part of the locking element of the second embodiment of the invention—a latch handle 72. This is a D-shaped ring element that may be fabricated from a piece of metal with a round cross section. The metal is bent into a "D" shape, whereas the midpoint of the straight edge or stem of the "D" is where two ends of the piece of metal meet. Two straight and opposing bottom pieces of the "D" ring are latch projections 72*b*. A rounded top portion of the "D" ring, a latch curve 72*a*, or latch handle element provides a means of engaging the locking pivot. Latch curve 72*a* can be otherwise formed in any shape such as, but not limited to, a round ring, square, round flat coin-like shape with ridges so that the form used enables the user to turn, screw in, pivot, or engage the pivot or locking device that secures closing member 34 to upper clamp 36. Materials for latch handle 72 and its parts may include, but are not limited to, plastics, metals or other suitable rigid, semirigid, or flexible materials. Latch handle 72 may be molded, cased, formed, extruded, bent, or otherwise fabricated.

FIG. 13B illustrates the changes necessary to holding clamp 22*b* of the first embodiment of the invention for this second embodiment of the invention. The same types of holding clamps as discussed in the first embodiment may be used with two modifications as follows to achieve the secondary locking means of holding clamp 70*b* of the second embodiment. Holding clamp closing member 34 as shown in FIG. 13B has a round hole cut, drilled, punched, molded, routed, bored, burned, or the like through the center of its surface—forming a closing member hole 74. An upper clamp opening or hole 75 is cut, punched, molded, drilled, routed, bored, burned, or the like through the center of the surface of upper clamp 36 forming an opening 75. Upper clamp opening 75 creates an oblong hole in the surface of upper clamp 38. On the opposing rounded ends of upper clamp opening 75 there are two upper clamp opening voids 75*b*. This oblong, ovoid, or otherwise suitably shaped hole also has two rounded projection indents 75*a* positioned substantially perpendicular to the long axis of voids 75*b*.

The second embodiment of the invention is assembled as shown in FIGS. 13A–13D using the above components as follows. As seen in FIGS. 13A and 13D, locking pivot 71 is inserted through hole 74 and holes 73 from a position between upper clamp 36 and holding clamp closing member 34 when clamp 70*b* is in the open position and has been installed into its final resting position in retention plate 44. The end upper portion of pivot 71, which contains locking pivot holes 71*a*, should be inserted upward through hole 74 and holes 73 until pivot 71 reaches the point at which locking pivot ring 71*b* rests against the underside of closing member 34 and closing member retainer 46. As shown in FIG. 13A, once pivot 71 is installed through hole 74 and holes 73, a washer 72*c* is placed into position on the upper half of pivot 71. Washer 72*c* is a stamped, die-cut, molded, or otherwise suitably fabricated part made of plastic, metal, or the like. Washer 72*c* can be included as a separate part as shown or can be combined as one part with latch handle 72, providing a smooth surface molded, formed, or otherwise fabricated integral to itself Once washer 72*c* is installed, latch handle 72 can be assembled onto article container 70. As seen in FIG. 13A, the two latch projections 72*b* are pulled apart, forcing the gap between the two projections to enlarge enough to accommodate the diameter of the head of locking pivot 71 in the location of locking pivot holes 71*a*. The ends of each projection 72*c* are inserted into locking pivot holes 71*a*. Due to the resilient nature of the material used for the latch handle, the tips of projections 72*c*, once inserted into holes 71*a*, spring forward toward one another, significantly decreasing the size of the gap between the two to their original, before-insertion, position. As mentioned earlier, pivot holes 71*a* extend toward each other as deep as possible toward the core or center of pivot 71, but are separated in the middle by a thin vertical wall or plate. As described and shown in FIG. 13C, the tips of projections 72*c*, once inserted, will spring forward to rest, with pressure, against this internal vertical wall or plate. It should be noted that there are other ways of connecting latch handle 72 to pivot 71. Some examples include gluing, providing spline and snap elements, screwing together with conventional fasteners, and the like.

Operation of Second Embodiment

Consistent with the first embodiment of the invention, the second embodiment requires the same initial action as is required for engaging the holding clamp onto clothing or the like and inserting items into the container portion. However, in the second embodiment, as described below, the user has the option of engaging a secondary locking device, locking pivot 71, thus providing more security in retaining article container 70 of the second embodiment, onto the user or any items to which it is clamped.

FIG. 13D illustrates the position of holding clamp 70*b* prior to engagement of the secondary locking means. Closing member 34, housed inside container clamp interface flap 28, is pressed forward such that locking pivot projections 71*c* are lined up on a vertical axis parallel to the vertical sides of holding clamp 70*b*. Accordingly, latch handle 72 is lined up vertically, thus lining up pivot projections 71*c* with voids 75*b* so that, when container clamp interface flap 28 and closing member 34 are pressed forward toward upper clamp 36, locking pivot projections 71*c* pass through upper clamp opening voids 75*b* and continue to be pushed forward through upper clamp opening 75. Once the locking pivot reaches this point, the user, holding latch curve portion 72*a* of latch handle 72 turns latch handle 72 until locking pivot projections 71*c* slide into and are thus retained by upper clamp opening indents 75*a* Here locking pivot 71 is in its fully closed and locked position, while exerting maximum force onto the garment or the like that is being retained within the mouth of holding clamp 70. Washer 72*c*, described earlier, as part of the latch mechanism reduces the wear of the tuning of latch handle 72 on flap 28 as well as provides a smooth surface to facilitate smooth turning action of handle 72.

This fully locked position, as illustrated in cross-sectional view in FIG. 13C, shows the engaged fabric or material sandwiched between the bottom end of pivot 71 and the upper inside surface of lower clamp providing additional retention properties. This strong retention of the engaged fabric is achieved through at least two main functional factors specific to this design. First, the constant (locked) pressure exerted upon the fabric by the lower portion of locking pivot 71 in its closed position forces the fabric or material in the mouth of the clamp to be tightly retained against lower clamp 38. Secondly, while the fabric or material in the mouth of the clamp is retained by the pressure of the closed position of locking pivot 71, it is further forced through and into the shallow cavity created by retention plate cut 44*c* superimposed upon the upper interior surface of lower clamp 38. FIG. 13F, shows that the resulting labyrinth path 76 created by the described elements of the second embodiment provides additional retainment security over the single snap locking clamp force of the clamp 22*b* of the first embodiment. A hole or indent 90 punched in lower clamp 38 adds gripping friction.

Once holding clamp 70*b* of the second embodiment of the invention is fully engaged and locked onto fabric, clothing or the like, latch handle 72 may be folded over to lie flat against the exterior surface of interface flap 28. At this point, as seen in FIG. 13, fastening means 56 of pocket closure extension 26 may be fastened to clamp flap fastening means 58 and may partially cover handle 72 and locking pivot or may preferably fully cover these components, provided that extension 26 is sized to fully conceal these components.

Description of Third Embodiment—Waterproof Means

The third embodiment of the present provides the first embodiment with waterproof containment means. This functions to allow articles to be contained and stay dry within the waterproof compartment(s) of the pouch for use of the invention while engaging in activity in water or snow-related activities.

Figure 17A:
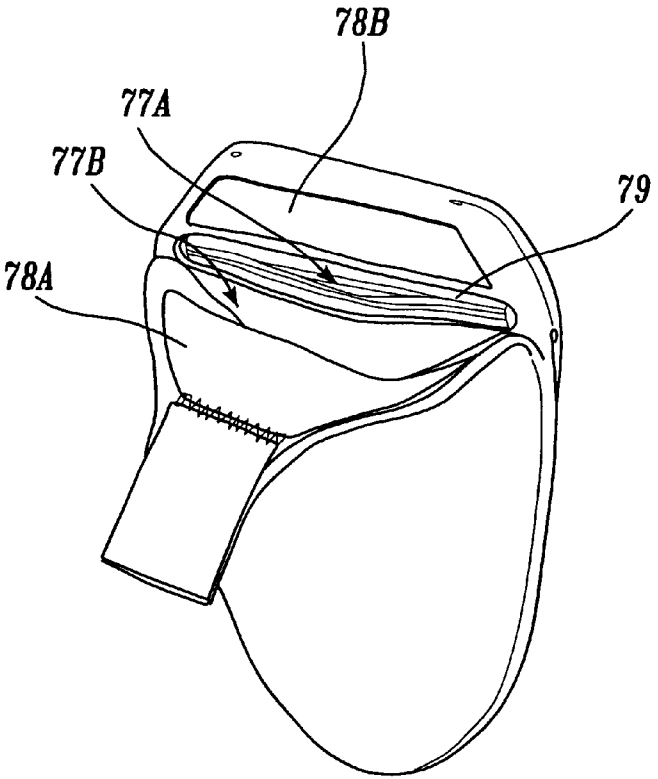
FIG. 17A is a rear perspective of the container and internal waterproof closure means showing the article cavity in an open position.
Figure 17:
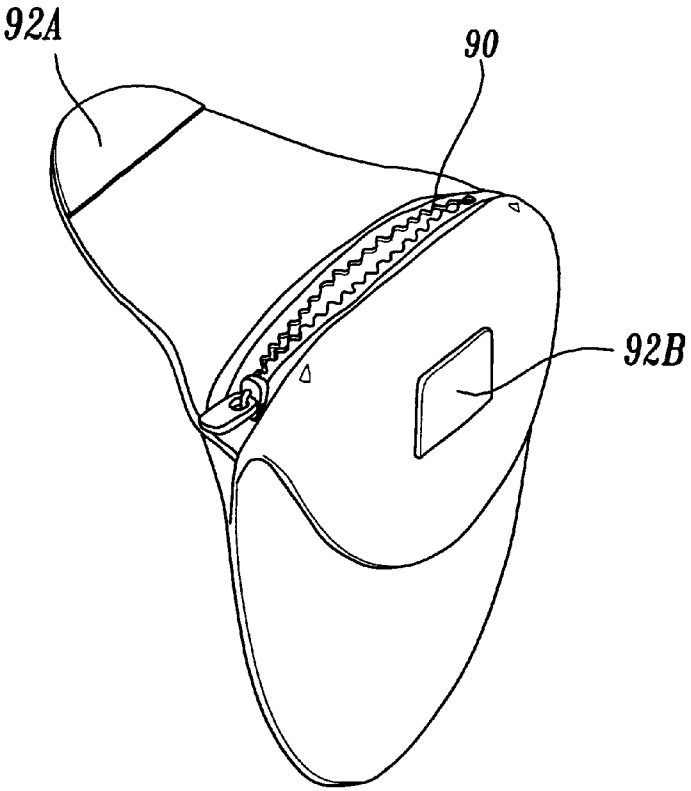
FIG. 17 is a front perspective view of an alternative to cavity closure means while showing the article cavity in an open position.

If desired, the whole main cavity of the invention, or pockets within it, may be waterproofed as shown in FIG. 17. In this case, a waterproof material is used for the container portion and sealed if necessary at the seams, or a waterproof liner or waterproof bag lining the container portion may be used. The waterproof cavity or cavities are then closed in a watertight matter using a waterproof closure, such as a waterproof zipper 90 as illustrated, or a flexible tongue-and-groove type of closure or other waterproofing closure means. As shown in FIG. 17, the waterproofed closure means may be attached to the container in place of fastening means 52 and 54 from the preferred embodiment of the invention or otherwise configured to seal off the main cavity or cavities. The container of FIG. 17 further includes hook-and-loop fasteners 92*a*, 92*b*.

FIG. 17A shows another configuration of providing one or more waterproof compartments 77*a*, 77*b* within the regular container cavity. The container cavity includes hook-and-loop fasteners 78*a*, 78*b*, and a flexible tongue-and-groove closure 79. Therefore, items necessary to stay dry, or in an element free environment, can be placed into the waterproof compartments and those that can get wet or don't need to be protected as extensively can be placed into the nonwaterproofed compartment.

Means of waterproofing one or more compartments within the main cavity, but not all, are to simply provide a waterproof single pocket or cavity area with waterproof closure inside the main cavity via means described above. Examples of waterproof materials are rubber laminated with nylon (or neoprene), rubber-backed nylon, plastic-coated materials, PVC, plastics, and the like. Seams of the waterproof compartment(s) may be sealed as necessary, as described above. Additional compartments may be added as desired in a similar fashion as described for more cavities and buoyancy means may be included via the materials used or air pockets.

Operation of the Third Embodiment of the Invention

Operation of this embodiment is apparent based upon the operational description of the primary embodiment and the above description of the third embodiment.

SUMMARY, RAMIFICATION AND SCOPE

Accordingly, the reader will see that the clipable article container of this invention can be used to comfortably carry personal items on one's person or attached to another item easily and conveniently.

It provides for superior, highly secure locking attachment to a wide range of clothing or other desired items, thus it cannot be pulled off or inadvertently fall off It is simple, quick and easy to attach and remove even with one hand and without damage to clothing.

It provides quick and easy insertion of and access to articles contained within, while still providing extra security to such items permits attachment and insertion or removal of articles in any order.

It permits the comfortable portability of items contained within, even when used in fitness, sport, or outdoor activities.

It permits great versatility in the area or position at which it may be attached to clothing or other items.

It permits attachment to an array of materials, from thin and delicate to thick.

It may effectively be used for a wide range of activities from everyday use as a wallet to travel, fitness, or outdoor activities.

Its elements ensure straight positioning of the article container when clamped on a straight edge.

It provides for highly efficient, low-cost, and flexible production and assembly.

It provides for the secure, but removable attachment of the clamp to the container.

It permits long-lasting use and reliability.

Its well integrated components maximize convenience and functionality in use.

Although the description above contains many specifics, these should not be construed as limiting the scope of the invention but as merely providing illustrations of some of the presently preferred embodiments of this invention. Thus, the invention may be embodied in many forms without departing from the spirit or essential characteristics of the invention The present embodiments are therefore to be considered in all respects as illustrative and not restrictive, the scope of the invention being indicated by the appended claims rather than by the foregoing description and all changes that come within the meaning and range of equivalency of the claims are therefore intended to be embraced therein.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A container detachably securable to an article of clothing or other item, comprising:

a first panel having a peripheral edge;

a second panel having a peripheral edge, the first and second panels being joined at their peripheral edges to form a pouch with an opening thereto, the pouch defining exterior and interior surfaces;

a clamp secured to the first panel of the pouch for detachably securing the container to an article of clothing or other item, the clamp including a first mating fastener; and a flap extending from the second panel adjacent the opening to the pouch, the flap folding over the exterior surface of the first panel and the clamp secured thereto, the flap including a second mating fastener, the first and second mating fasteners being repeatedly matable so as to selectively fasten the flap to the clamp, the flap being liftable to open the pouch while the clamp remains secured to the exterior surface of the first panel.

2. The container of claim 1, wherein the clamp comprises a sprung bistable clamp.

3. The container of claim 2, wherein the clamp comprises an upper clamp member defining an upper edge portion, and a lower clamp member defining a lower edge portion that is adapted to mate with the upper edge portion when the clamp is closed.

4. The container of claim 3, wherein the flap is fastenable to a surface carried on the upper clamp member.

5. The container of claim 3, wherein the clamp further comprises a retention plate secured to the first panel of the pouch, the lower clamp member being fastened to the retention plate.

6. The container of claim 5, wherein the retention plate defines a recess that receives the upper edge portion of the upper clamp member when the clamp is closed.

7. The container of claim 5, wherein the lower clamp member is integrally formed with the retention plate.

8. The container of claim 3, wherein the clamp further comprises a retention plate secured to the first panel of the pouch, the lower clamp member being fastened to the retention plate, wherein the retention plate defines a feed-in ramp leading to an interface between the upper edge portion and the lower edge portion.

9. The container of claim 1, wherein the clamp comprises an upper clamp member defining an edge flange portion and an opposing lower clamp member defining a recess that receives the edge flange portion of the upper clamp member when the clamp is closed.

10. The container of claim 1, further comprising a fastener for selectively closing the opening to the pouch.

11. The container of claim 10, wherein the fastener is disposed between the first and second panels at the opening to the pouch.

12. The container of claim 10, wherein the fastener is selected from the group consisting of mating hook-and-loop strips, fabric-backed fasteners, sheet fasteners, snaps, and zippers.

13. The container of claim 1, wherein the clamp is secured to the exterior surface of the first panel.

14. The container of claim 1, wherein the clamp is assembled integrally with the first panel.

15. The container of claim 1, wherein the flap is formed integrally with the second panel.

16. The container of claim 1, further comprising a second flap extending from the first panel adjacent the opening to the pouch.

17. A container detachably securable to an article of clothing or other item, comprising:

a first panel having a peripheral edge;

a second panel having a peripheral edge, the first and second panels being joined at their peripheral edges to form a pouch with an opening thereto, the pouch defining exterior and interior surfaces; and a clamp for detachably securing the container to an article of clothing or other item, the clamp including an upper clamp member having a first mating fastener, a lower clamp member pivotably coupled to the upper clamp member, and means for closing the upper and lower clamp members, the lower clamp member being secured to the first panel of the pouch;

wherein at least one of the first and second panels defines a flap extending upwardly to fold downwardly over the clamp, the flap including a second mating fastener, the first and second mating fasteners being repeatedly matable so as to selectively fasten the flap to a surface carried on the upper clamp member of the clamp.

18. The container of claim 17, wherein the flap extends from the first panel.

19. The container of claim 17, wherein the flap extends from the second panel.

20. The container of claim 17, wherein both the first and second panels define flaps, respectively.

21. The container of claim 17, further comprising a fastener for selectively closing the opening to the pouch.

22. A container detachably securable to an article of clothing or other item, comprising:

a first panel having a peripheral edge;

a second panel having a peripheral edge, the first and second panels being joined at their peripheral edges to form a pouch with an opening thereto, the pouch defining exterior and interior surfaces;

a clamp secured to the exterior surface of the first panel of the pouch for detachably securing the container to an article of clothing or other item, the clamp including a first jaw secured to the first panel and an opposing second jaw; and a flap extending from the first panel adjacent the opening to the pouch and being coupled to the second jaw, the flap spanning in at least one direction either laterally beyond a width of the second jaw or downwardly beyond a length of the second jaw.

23. The container of claim 22, wherein the flap comprises a flexible cover.

24. The container of claim 22, wherein the flap is formed separately from the second jaw of the clamp.

25. A container detachably securable to an article of clothing or other item, comprising:

a first panel having a peripheral edge;

a second panel having a peripheral edge, the first and second panels being joined at their peripheral edges to form a pouch with an opening thereto, the pouch defining exterior and interior surfaces;

a clamp secured to the first panel of the pouch for detachably securing the container to an article of clothing or other item, the clamp including a first mating fastener; and a flap extending from the first panel adjacent the opening to the pouch, the flap folding over the exterior surface of the first panel and the clamp secured thereto, the flap including a second mating fastener, the first and second mating fasteners being repeatedly matable so as to selectively fasten the flap to the clamp.

26. The container of claim 25, wherein the clamp comprises a sprung bistable clamp.

27. The container of claim 26, wherein the clamp comprises an upper clamp member defining an upper edge portion, and a lower clamp member defining a lower edge portion that is adapted to mate with the upper edge portion when the clamp is closed.

28. The container of claim 27, wherein the flap is fastenable to a surface carried on the upper clamp member.

29. The container of claim 27, wherein the clamp further comprises a retention plate secured to the first panel of the pouch, the lower clamp member being fastened to the retention plate.

30. The container of claim 25, further comprising a fastener for selectively closing the opening to the pouch.

31. The container of claim 25, wherein the clamp is secured to the exterior surface of the first panel.

32. The container of claim 25, wherein the clamp is assembled integrally with the first panel.

33. The container of claim 25, wherein the flap is formed integrally with the first panel.

* * * * *